US011316294B2

(12) United States Patent
Flaherty, IV et al.

(10) Patent No.: US 11,316,294 B2
(45) Date of Patent: Apr. 26, 2022

(54) MINIATURIZED ELECTRICAL CONNECTOR SYSTEMS

(71) Applicant: Corning Optical Communications RF LLC, Glendale, AZ (US)

(72) Inventors: Thomas Edmond Flaherty, IV, Surprise, AZ (US); Daniel Michael Grabowski, Goodyear, AZ (US); Brian Lyle Kisling, Youngtown, AZ (US)

(73) Assignee: Corning Optical Communications RF LLC, Charlotte, NC (US)

( * ) Notice: Subject to any disclaimer, the term of this patent is extended or adjusted under 35 U.S.C. 154(b) by 123 days.

(21) Appl. No.: 16/635,874

(22) PCT Filed: Jul. 26, 2018

(86) PCT No.: PCT/US2018/043860
§ 371 (c)(1),
(2) Date: Jan. 31, 2020

(87) PCT Pub. No.: WO2019/027792
PCT Pub. Date: Feb. 7, 2019

(65) Prior Publication Data

US 2020/0161789 A1 May 21, 2020

Related U.S. Application Data

(60) Provisional application No. 62/539,099, filed on Jul. 31, 2017.

(51) Int. Cl.
*H01R 13/24* (2006.01)
*H01R 13/64* (2006.01)
(Continued)

(52) U.S. Cl.
CPC ..... *H01R 13/2421* (2013.01); *H01R 13/502* (2013.01); *H01R 13/6275* (2013.01); *H01R 13/64* (2013.01); *H01R 24/568* (2013.01)

(58) Field of Classification Search
CPC .. H01R 13/2421; H01R 13/64; H01R 24/568; H01R 24/56; H01R 13/6275;
(Continued)

(56) References Cited

U.S. PATENT DOCUMENTS 6,712,648 B2 3/2004 Padro et al.
6,843,657 B2 * 1/2005 Driscoll ..... H01R 12/7064 439/65
(Continued)

FOREIGN PATENT DOCUMENTS

DE 29604551 U1 6/1996
GB 2402561 A 12/2004
(Continued)

OTHER PUBLICATIONS

International Search Report and Written Opinion of the International Searching Authority; PCT/US2018/043860; dated Dec. 13, 2018; 22 Pages; European Patent Office.

*Primary Examiner* — Travis S Chambers
(74) *Attorney, Agent, or Firm* — Tamika A. Crawl-Bey

(57) ABSTRACT

Miniaturized electrical connector systems are disclosed herein. In exemplary aspects disclosed herein, the connector system includes a twinaxial female connector having a housing and at least one dielectric positioned therein. The at least one dielectric defines two parallel channels configured to receive at least a portion of two conductors of a twinaxial cable. The twinaxial female connector includes an oval interface configured to orient and align the conductors of the twinaxial cable with mating pins of a male connector. The twinaxial female connector further includes two spring-type interconnects positioned within the oval interface, each configured to directly contact a conductor of the twinaxial cable and a mating pin of the male connector. The twinaxial female connector further includes a retaining clip attached to an exterior of the housing with a lever arm biased towards
(Continued)

and pivotable from an engaged orientation. Such features reduce the manufacturing complexity, cost, and overall size.

6 Claims, 29 Drawing Sheets

(51) Int. Cl.
*H01R 24/56* (2011.01)
*H01R 13/627* (2006.01)
*H01R 13/502* (2006.01)

(58) Field of Classification Search
CPC .. H01R 13/2407; H01R 13/502; H01R 24/38; H01R 33/20
See application file for complete search history.

(56) References Cited

U.S. PATENT DOCUMENTS 6,929,482 B2 8/2005 Benham
7,744,403 B2 6/2010 Barr et al.
8,323,058 B2 12/2012 Flaherty et al.
8,568,163 B2 10/2013 Burris et al.
8,597,050 B2 12/2013 Flaherty et al.
8,986,041 B2 * 3/2015 Oka ..... H01R 9/0518 439/374
9,071,019 B2 * 6/2015 Burris ..... H01R 13/639
9,496,667 B2 * 11/2016 Gardner ..... H01R 31/06
9,645,172 B2 * 5/2017 Santos ..... H01R 9/0518
2004/0168318 A1 * 9/2004 Johnson ..... H01R 13/6599 29/876
2010/0304579 A1 * 12/2010 Kisling ..... H01R 13/6275 439/63
2015/0222062 A1 * 8/2015 Sloey ..... H01R 24/40 439/578
2015/0349472 A1 * 12/2015 Zebhauser ..... H01R 24/38 439/660
2016/0104956 A1 4/2016 Santos et al.

FOREIGN PATENT DOCUMENTS

JP 56051282 U 5/1981
WO 2004/010749 A2 1/2004
WO 2008/067268 A1 6/2008

* cited by examiner

MINIATURIZED ELECTRICAL CONNECTOR SYSTEMS

CROSS REFERENCE TO RELATED APPLICATIONS

This application claims the benefit of priority of U.S. Provisional Application Ser. No. 62/539,099, filed Jul. 31, 2017, the content of which is relied upon and incorporated herein by reference in its entirety.

BACKGROUND

The disclosure relates to electrical cabling connectors for establishing electrical connections between mated electrical connectors, and more particularly to connectors with improved mechanical and electrical engagement.

Coaxial and twinaxial connectors are frequently used to establish electrical connections between different electronic devices and/or electronic components to establish electronic communication therebetween. Coaxial and twinaxial connectors are electrical connectors typically used with coaxial and twinaxial cables, respectively, to maintain a quality connection and shielding across the connection of coaxial or twinaxial components. A coaxial cable includes a single inner conductor, whereas a twinaxial cable includes two inner conductors. In particular, coaxial and twinaxial connectors are configured to carry (e.g., propagate) electrical signals (e.g., frequency signals, radio frequency (RF) signals, microwave RF signals, etc.) across the connection of coaxial or twinaxial components. Twinaxial connectors are becoming more popular in short range, high speed, differential signaling applications.

Current coaxial and twinaxial connectors typically include a pin contact in a male connector and a socket contact in a female connector. For the socket to receive the pin therein, the socket has a larger diameter than the pin. To maintain mechanical and electrical engagement of the male and female connectors, coaxial and twinaxial connector interface designs typically include an external coupling mechanism, such as bayonet coupling components. Examples of such bayonet coupling components include a BNC (Bayonet Neill-Concelman) connector and a TNC (Threaded Neill-Concelman) connector. These components may be difficult to manufacture as they are typically made of metal and/or they may be difficult to use in smaller applications as they typically require rotation. Other coupling systems used with current coaxial and twinaxial connectors include a male connector configured to receive a female connector with circumferentially positioned spring fingers. Such a coupling system may be easier to use, but may still be difficult to manufacture and may be less secure than other options. In either case, the coupling systems described above are circumferentially positioned around the male and female connectors. Additionally, in such coaxial and twinaxial connectors, the conductors of the coaxial and twinaxial cablings are usually electrically and mechanically connected to the connector interface by soldering.

These electrical connections, coupling mechanisms, and required soldering each add to the manufacturing complexity and cost of these connectors, as well as their overall size (e.g., height and/or width). Thus, such features limit how densely they may be positioned together, such as on a printed circuit board (PCB).

No admission is made that any reference cited herein constitutes prior art. Applicant expressly reserves the right to challenge the accuracy and pertinency of any cited documents.

SUMMARY

Embodiments of the disclosure are directed to miniaturized electrical connector systems. In exemplary aspects disclosed herein, the connector system includes a twinaxial female connector having a housing and at least one dielectric positioned within the housing. The at least one dielectric defines two parallel channels configured to receive at least a portion of two conductors of a twinaxial cable. The twinaxial female connector includes an oval interface configured to facilitate insertion into a corresponding male connector to orient and align the conductors of the twinaxial cable with male mating pins of the male connector. The twinaxial female connector further includes two spring-type interconnects positioned within the oval interface, each configured to directly contact a conductor of the twinaxial cable and a mating pin of the male connector, thereby providing electrical communication therebetween without any soldering. These interconnects reduce the overall size of the female connector as the female contact can be about the same size or even smaller than the male mating pin and no soldering is required. The twinaxial female connector further includes a retaining clip to maintain engagement and a grounding connection between the twinaxial female connector and the male connector. The retaining clip is attached to an exterior of the housing with a lever arm biased towards and pivotable from an engaged orientation, making it secure and easy to use. As the lever arm is not circumferentially patterned around the twinaxial female connector, the width of the female connector is reduced. Accordingly, such features reduce the manufacturing complexity and cost of these connectors, as well as their overall size (e.g., height and/or width) allowing for such connectors to be more densely positioned adjacent to one another.

One embodiment of the disclosure relates to a twinaxial cable connector comprising a housing and at least one dielectric positioned within the housing. The housing comprises a housing first end and a housing second end. The housing first end comprises a non-circular interface. At least a portion of the non-circular interface is configured for insertion into a mating connector. At least one dielectric is positioned within the housing. The at least one dielectric comprises a dielectric first end and a dielectric second end. The at least one dielectric defines a first channel and a second channel parallel to each other and extending from the dielectric first end to the dielectric second end. The first channel is configured to receive at least a portion of a first conductor of a twinaxial cable and the second channel is configured to receive at least a portion of a second conductor of the twinaxial cable. The non-circular interface is configured to orient the first and second conductors of the twinaxial cable with first and second electrical connections of the mating connector.

An additional embodiment of the disclosure relates to a cable connector comprising a housing, at least one dielectric positioned within the housing, and a spring-type interconnect. The housing comprises a housing first end and a housing second end. The at least one dielectric comprises a dielectric first end and a dielectric second end. The at least one dielectric defines at least one channel extending from the dielectric first end to the dielectric second end. The dielectric second end is configured to receive at least a portion of at least one conductor of a cable. The spring-type interconnect is positioned within the at least one channel proximate an insulation first end. The spring-type interconnect comprises an interconnect first end and an interconnect second end. The interconnect first end is configured to establish direct electrical contact with a mating pin of a mating connector, and the interconnect second end is configured to establish electrical communication with the at least one conductor of the cable.

An additional embodiment of the disclosure relates to a cable connector comprising a housing, at least one dielectric positioned within the housing, and a retaining clip attached to an exterior of the housing. The housing comprises a housing first end and a housing second end. The at least one dielectric comprises a dielectric first end and a dielectric second end. The at least one dielectric defines at least one channel extending from the dielectric first end to the dielectric second end. The dielectric second end is configured to receive at least a portion of at least one conductor of a cable. The retaining clip comprises a lever arm biased towards and pivotable from an engaged orientation relative to the housing. The retaining clip comprises a forwardly extending lever arm configured to engage an exterior of a mating connector and a rearwardly extending push tab to selectively pivot the retaining clip from the engaged orientation.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 1A:
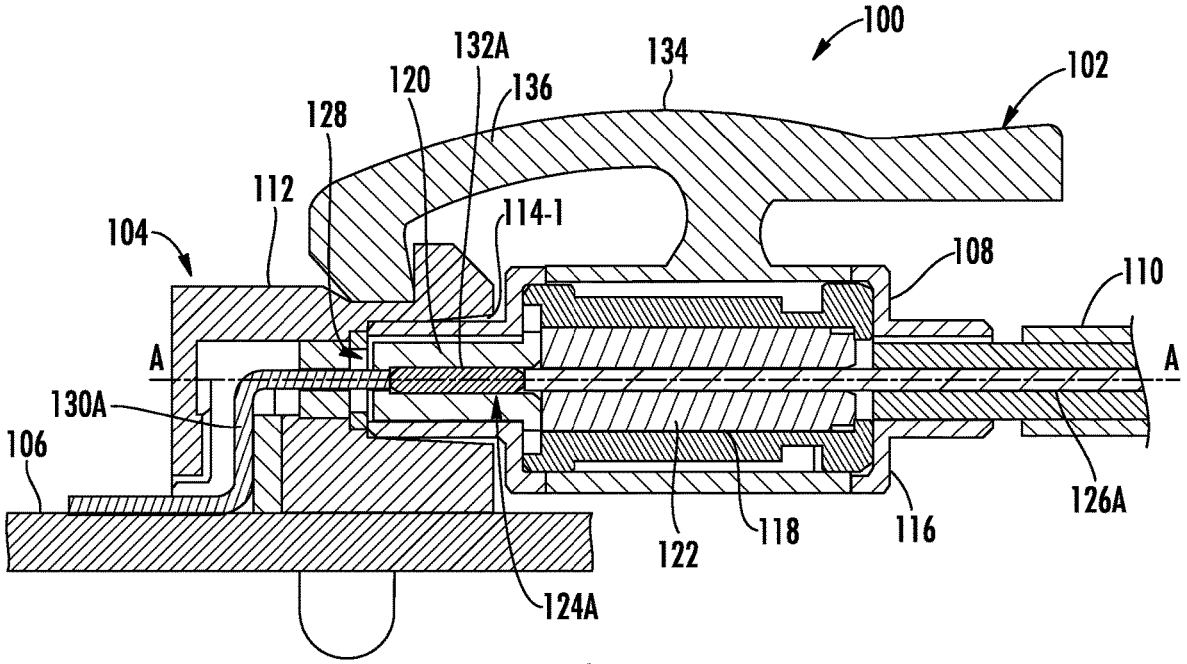
FIG. 1A is a cross-sectional view of one embodiment of an electrical connection system illustrating an exemplary female cable assembly mated with a male block assembly, the cable assembly including a female connector and the block assembly including a male connector.

Embodiments of the disclosure are directed to miniaturized electrical connector systems. In exemplary aspects disclosed herein, the connector system includes a twinaxial female connector having a housing and at least one dielectric positioned within the housing. The at least one dielectric defines two parallel channels configured to receive at least a portion of two conductors of a twinaxial cable. The twinaxial female connector includes an oval interface configured to facilitate insertion into a corresponding male connector to orient and align the conductors of the twinaxial cable with male mating pins of the male connector. The twinaxial female connector further includes two spring-type interconnects positioned within the oval interface, each configured to directly contact a conductor of the twinaxial cable and a mating pin of the male connector, thereby providing electrical communication therebetween without any soldering. These interconnects reduce the overall size of the female connector as the female contact can be about the same size or even smaller than the male mating pin and no soldering is required. The twinaxial female connector further includes a retaining clip to maintain engagement and a grounding connection between the twinaxial female connector and the male connector. The retaining clip is attached to an exterior of the housing with a lever arm biased towards and pivotable from an engaged orientation, making it secure and easy to use. As the lever arm is not circumferentially patterned around the twinaxial female connector, the width of the female connector is reduced. Accordingly, such features reduce the manufacturing complexity and cost of these connectors, as well as their overall size (e.g., height and/or width) allowing for such connectors to be more densely positioned adjacent to one another.

Reference will now be made in detail to the present preferred embodiments, examples of which are illustrated in the accompanying drawings. Whenever possible, the same reference numerals will be used throughout the drawings to refer to the same or like parts.

Figure 1B:
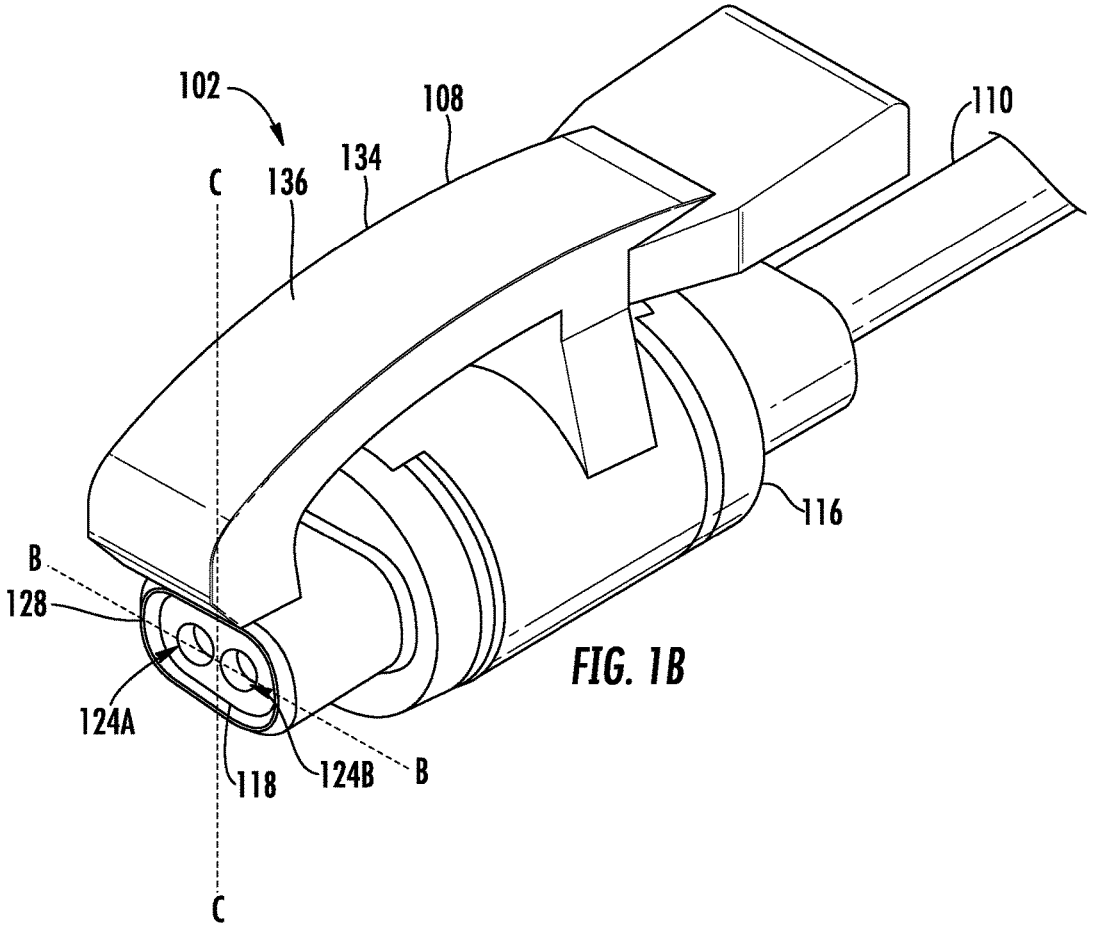
FIG. 1B is a perspective view of the cable assembly of FIG. 1A.
Figure 1C:
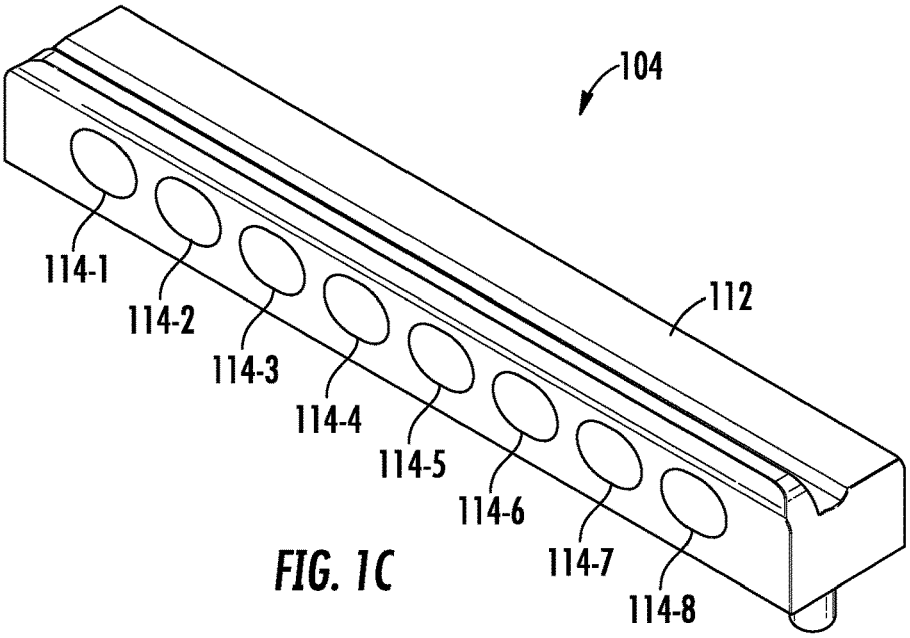
FIG. 1C is a perspective view of the block assembly of FIG. 1A.
Figure 2A:
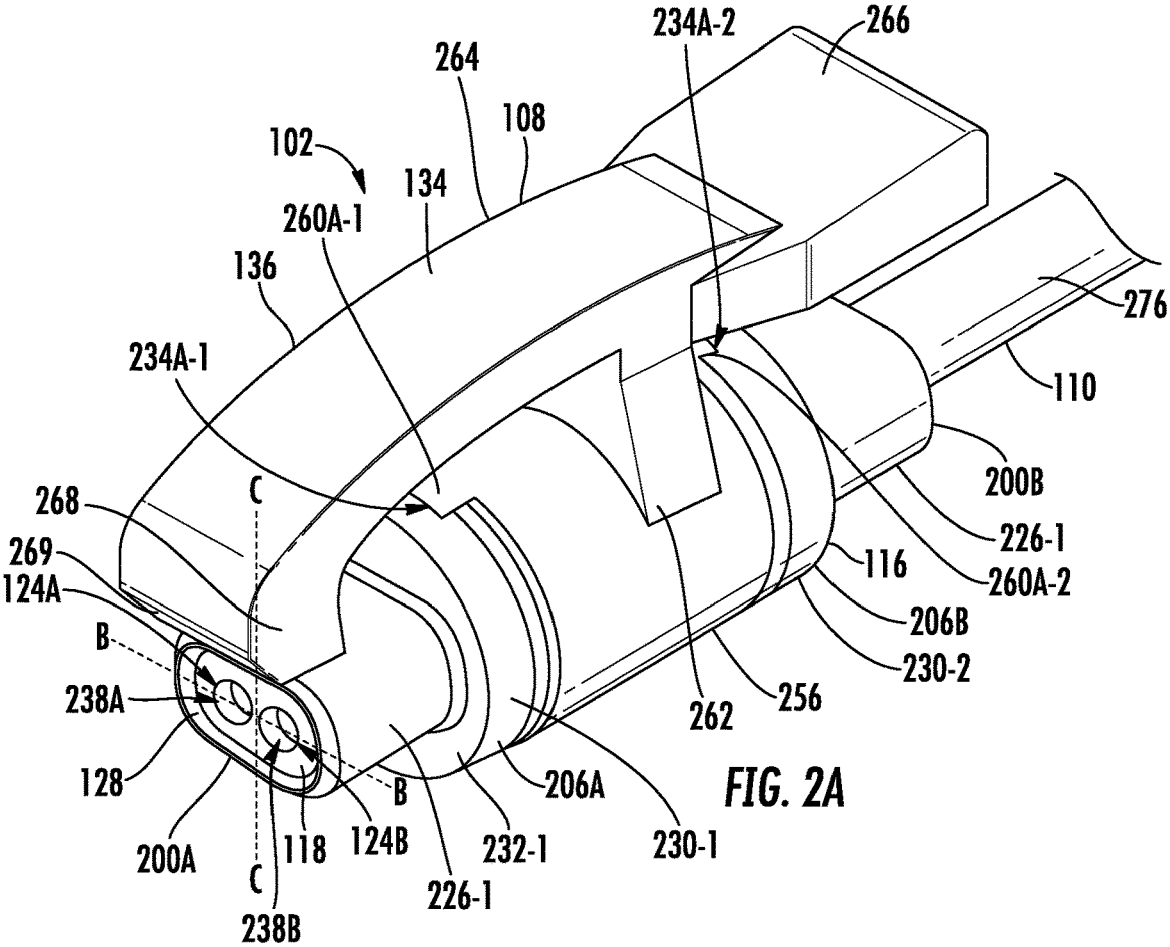
FIG. 2A is a perspective view of the cable assembly of FIGS. 1A-1B.
Figure 2B:
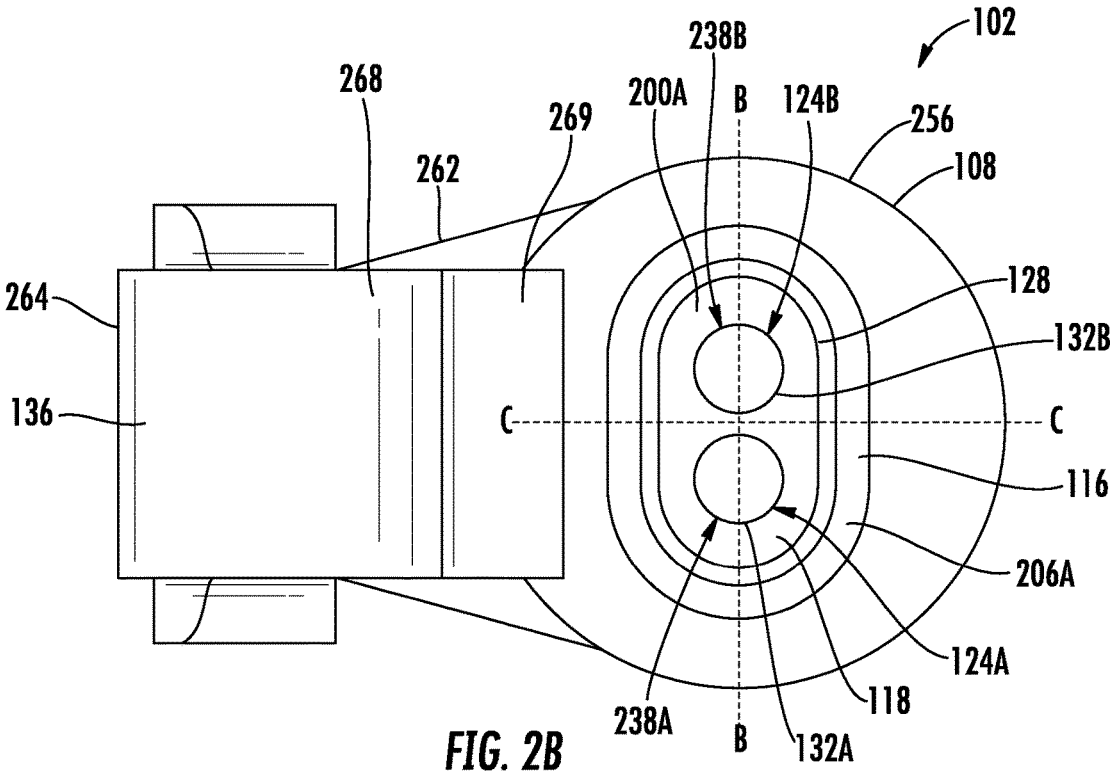
FIG. 2B is a front view of the cable assembly of FIG. 2A.
Figure 2C:
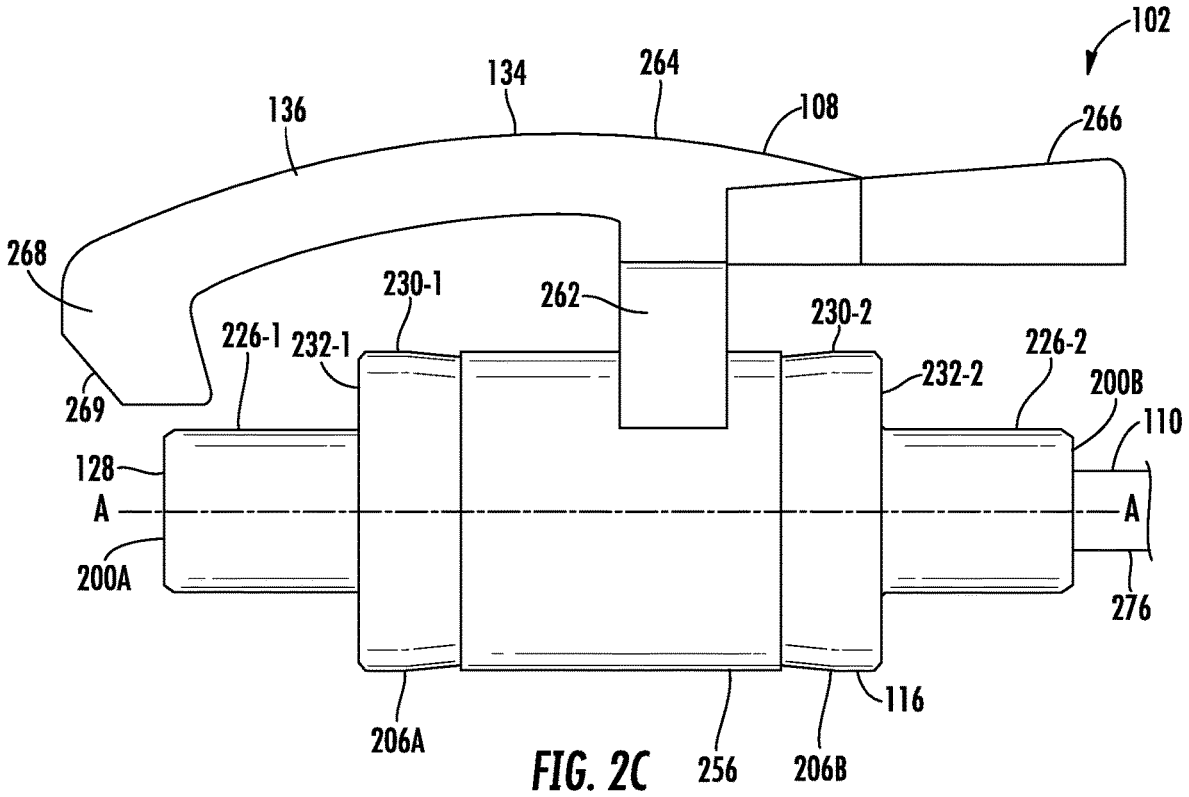
FIG. 2C is a side view of the cable assembly of FIG. 2A.
Figure 2D:
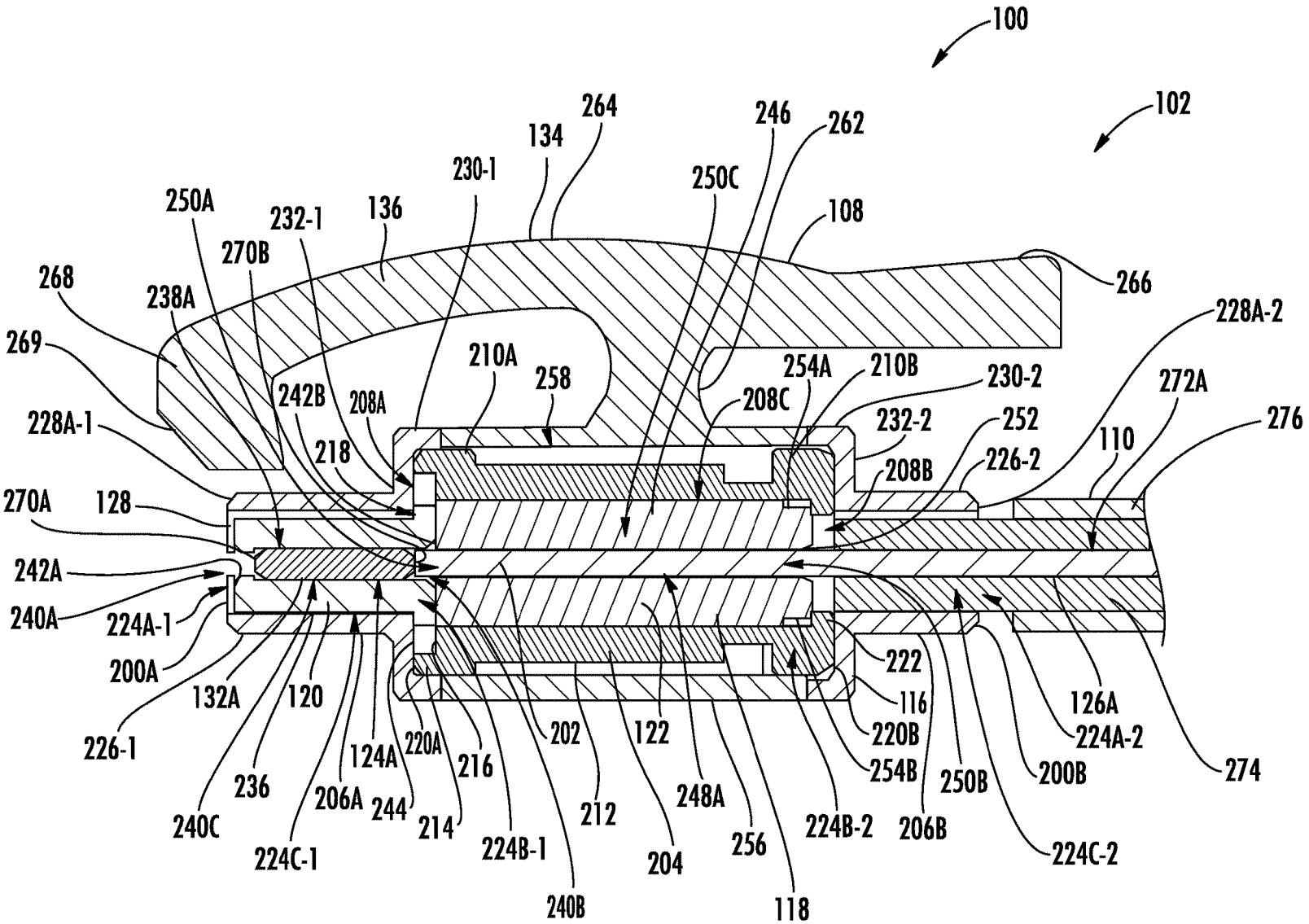
FIG. 2D is a cross-sectional side view of the cable assembly of FIG. 2A.
Figure 2E:
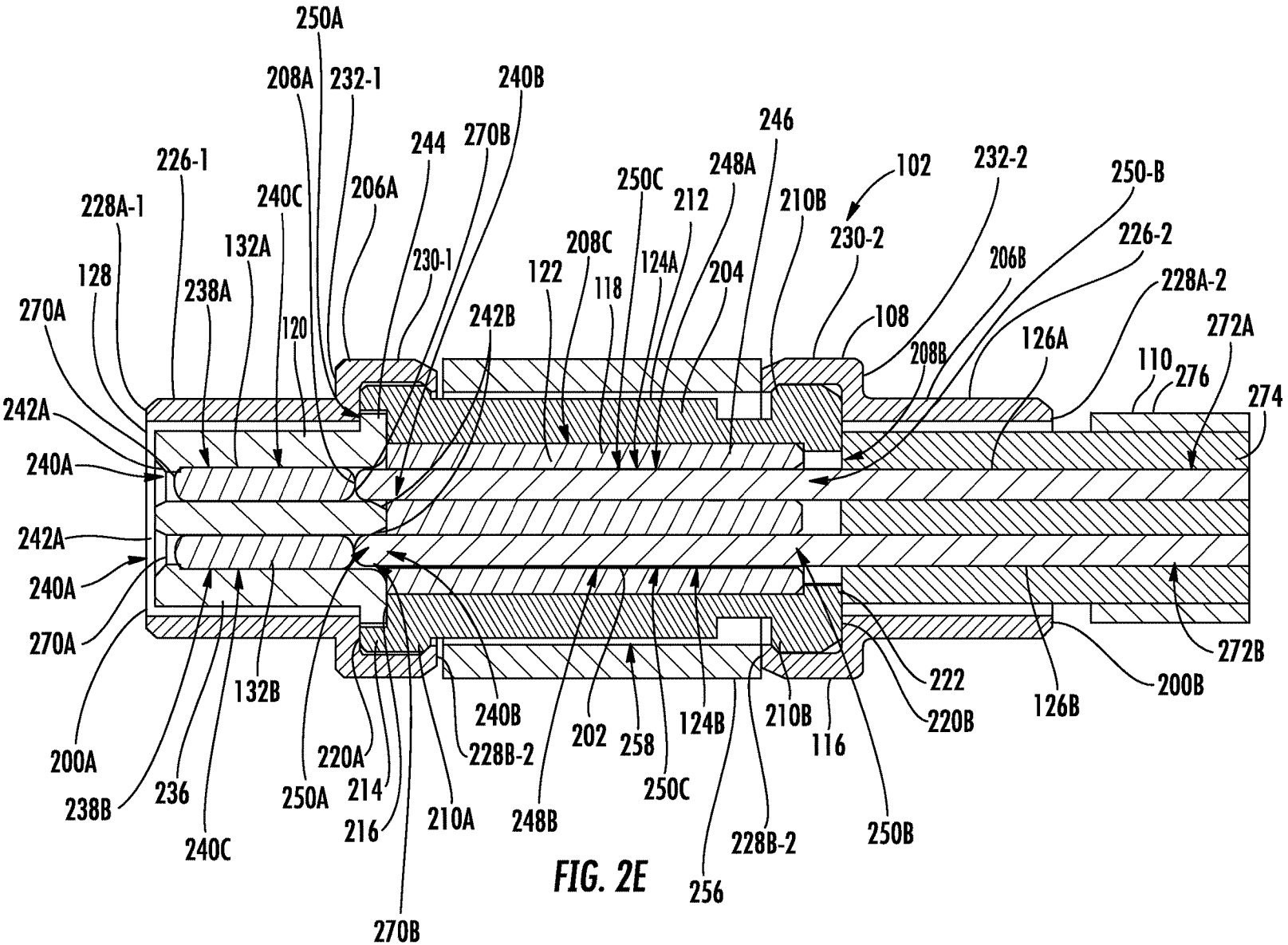
FIG. 2E is a cross-sectional top view of the cable assembly of FIG. 2A.
Figure 2F:
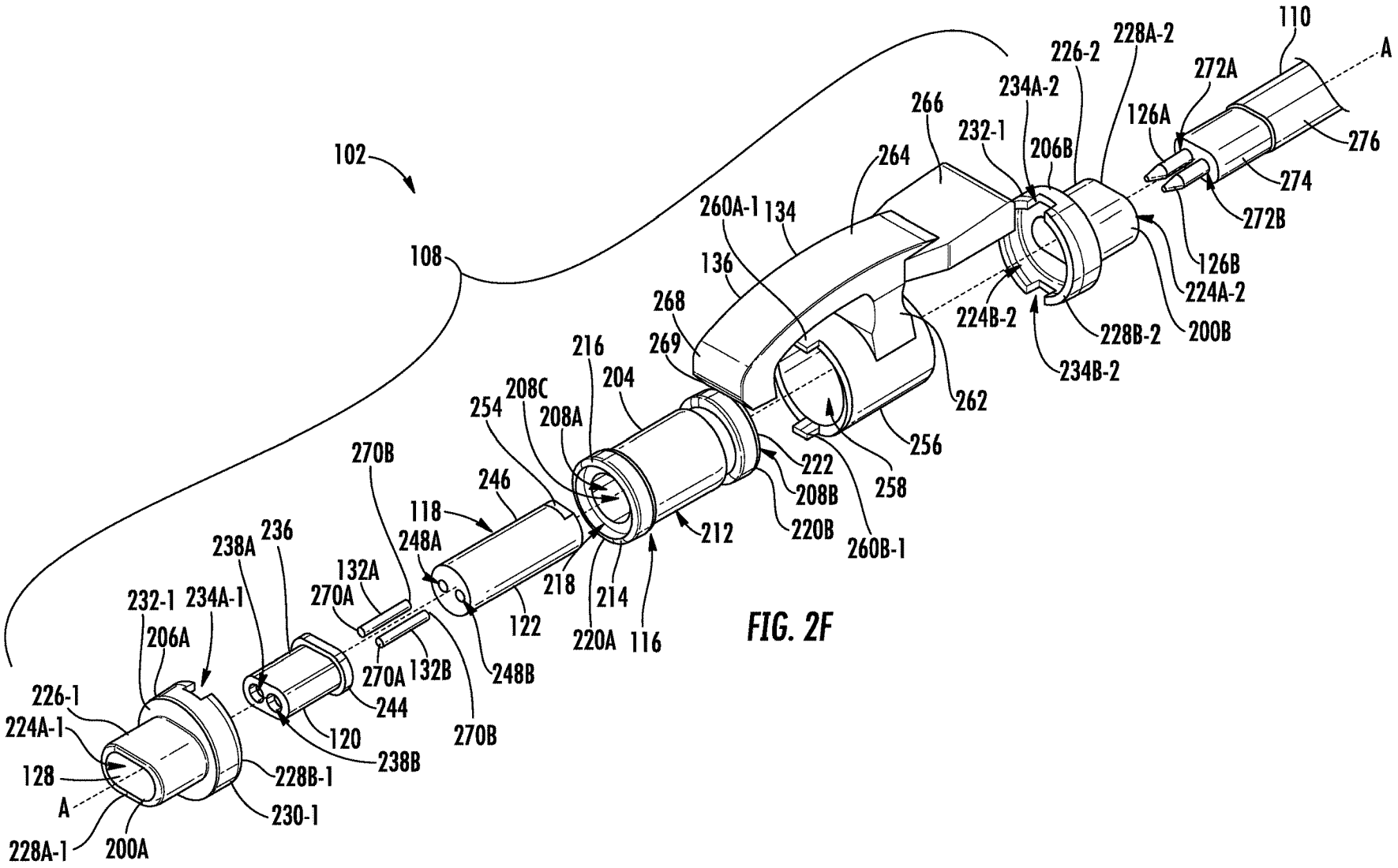
FIG. 2F is an exploded perspective view of the cable assembly of FIG. 2A.

FIGS. 1A-1C are views of one embodiment of an electrical connection system 100 illustrating an exemplary cable assembly 102 (also referred to herein as a female connector assembly) mated to a block assembly 104 (also referred to herein as a male connector assembly) mounted to a printed circuit board (PCB) 106. The cable assembly 102 includes a female connector 108 (also referred to as a first mating connector, twinaxial female connector, etc.) and cabling 110 (also referred to as twinaxial cabling, etc.). The block assembly 104 includes a housing 112 with one or more male connectors 114-1 to 114-8 (referred to generally as male connectors 114). It is noted that twinaxial cables and connectors are described herein, but that the features disclosed may also be used with coaxial cables and connectors and/or other types of cables and connectors.

The female connector 108 includes a housing 116 (also referred to herein as a housing assembly, housing subassembly, etc.) and an insulation feature 118 (also referred to herein as an insulation assembly, insulation subassembly, etc.) positioned within the housing 116. The insulation feature 118 includes a first dielectric 120 and a second dielectric 122 (as explained in more detail below). Further, the insulation feature 118 defines a left channel 124A and a right channel 124B parallel to each other. The left channel 124A and the right channel 124B are configured to receive at least a portion of a left conductor 126A and a right conductor 126B of the cabling 110. The female connector 108 further includes a non-circular interface 128 (e.g., oval interface) to rotationally orient and align the left conductor 126A and the right conductor 126B (not shown) of the cabling 110 with left pin 130A (also referred to herein a left male mating pin, etc.) and right male mating pin 130B (not shown). The female connector 108 further includes a left spring-type interconnect 132A and a right spring-type interconnect 130B (also referred to as a conductor, female conductor, contact, female contact, etc.) positioned within the non-circular interface 128. Each of the left spring-type interconnect 132A and right spring-type interconnect 132B is configured to directly contact one of the left conductor 126A and the right conductor 126B of the cabling 110 and one of the left pin 130A and the right pin 130B of the male connector 114, thereby providing electrical communication therebetween without any need for soldering. These interconnects 132A, 132B reduce the overall size of the female connector 108 as the female contact can be about the same size (e.g., diameter) or even smaller than the left pin 130A and right pin 130B and no soldering is required. The female connector 108 further includes a retaining clip 134 (also referred to herein as an engagement assembly, engagement subassembly, etc.) attached to an exterior of the housing 116. The retaining clip 134 includes a lever arm 136 biased towards and pivotable from an engaged orientation (as shown in FIG. 1A), making it secure and easy to use. As the lever arm 136 is not circumferentially patterned around the female connector 108, the width of the female connector 108 is reduced. Accordingly, such features reduce the manufacturing complexity and cost of the female connector 108 and male connector 114, as well as reduce their overall size (e.g., height and/or width), thereby allowing for the female connector 108 and male connectors 114-1 to 114-8 to be more densely positioned adjacent to one another.

FIGS. 2A-2F are views of the cable assembly 102 of FIGS. 1A-1B. The cable assembly 102 includes a female connector 108 and cabling 110. The female connector 108 may be of any size, but can also be about as small as a 0.12 in width, a 0.341 in length, and/or a 0.2 in height. In particular, the female connector 108 includes a first end 200A (also referred to herein as a distal end, first end, etc.) and a second end 200B (also referred to herein as a proximal end, back end, etc.) opposite the first end 200A, and a central axis A-A therebetween. The female connector 108 further includes a non-circular interface 128 at the first end 200A and the cabling 110 at the second end 200B. The non-circular interface 128 includes the left spring-type interconnect 132A and the right spring-type interconnect 132B. The left and right spring-type interconnects 132A, 132B are configured to be inserted and retained within the first dielectric 120. The left and right spring-type interconnects 132A, 132B may be a spring contact (also referred to as a spring member), similar to a compression spring. Alternatively, the left and right spring-type interconnects 132A, 132B may be floss pins (e.g., Fuzz Button). In either case, the spring-type interconnects 132A, 132B are configured to create an electrical connection between the left and right conductors 126 of the cabling 110 and left and right conductor pins 130A, 130B of the male connector 114. It is noted that the distance (e.g., pitch) between the left and right spring-type interconnects 132A, 132B and the left and right conductor pins 130A, 130B may be any size, but may be smaller than 0.025 in.

The non-circular interface 128 rotationally aligns the left and right spring-type interconnects 130A, 130B with corresponding left and right conductor pins 130A, 130B of the male connector 114 (also referred to herein as a second mating connector, twinaxial male connector, port, jack, etc.), such as around the central axis A-A. In other words, unlike a circle (e.g., as with coaxial connectors), the non-circular interface 128 can only mate with the male connector 114 in particular orientations. The non-circular interface 128 is shown as an ovular interface, although other shapes may be used (e.g., rectangle, square, triangle, etc.). Further, the non-circular interface 128 shown has only two axes of symmetry, Axis B-B and Axis C-C. It is noted that the non-circular interface 128 may have zero, one, two, or more axes of symmetry. For example, the non-circular interface 128 may have zero axes of symmetry (e.g., a scalene triangle) or one axis of symmetry (e.g., an egg shape) so that the non-circular interface 128 may only be inserted into the male connector 114 in one orientation.

The female connector 108 includes a housing 116 which forms a grounding path, a retaining clip 134 attached to the housing 116 for maintaining electrical ground and mechanical engagement between the female connector 108 and the male connector 114, an insulation feature 118 positioned within the housing 116, and an electrical trace 202 (also referred to herein as an electrical trace assembly, electrical trace subassembly, etc.) positioned within the insulation feature 118 and the housing 116. The insulation feature 118 electrically insulates the electrical trace 202 from the housing 116.

The housing 116 includes a body casing 204 (also referred to as a center casing), a first endcap 206A (also referred to as a front endcap, collar, etc.), and a second endcap 206B (also referred to as a back endcap, collar, etc.), where the body casing 204 is positioned between the first endcap 206A and the second endcap 206B. The body casing 204, first endcap 206A, and second endcap 206B house the insulation feature 118 and at least a portion of the electrical trace 202 therein. Further, the housing 116 (e.g., body casing 204, first endcap 206A, and second endcap 206B) may be made of metal and provide a grounding path between the cabling 110 and the male connector 114. It is noted that the first endcap 206A and the second endcap 206B are of an identical construction for ease of construction (e.g., by stamping) and to reduce manufacturing costs.

The body casing 204 is generally cylindrical with a circular cross-section and defines a first opening 208A at a first end (towards the female connector first end 200A), a second opening 208B at a second end (towards the female connector second end 200B), and an interior 208C therebetween. The circular shape of the body casing 204 facilitates ease of manufacturing and reduces manufacturing costs as it may be difficult to machine a non-circular body casing 204 of that length. The first opening 208A, second opening 208B, and interior 208C have a generally circular cross-sectional shape. The body casing 204 further includes a first outer shoulder 210A (also referred to herein as a front outer shoulder, first external shoulder, etc.) at or proximate the first opening 208A of the first end and a second outer shoulder 210B (also referred to herein as a back outer shoulder, second external shoulder, etc.) at or proximate the second opening 208B. The body casing 204 thereby defines a recessed center portion 212 between the first outer shoulder 210A and the second outer shoulder 210B. As explained in more detail below, the retaining clip 134 is positioned around the recessed center portion 212, between the first outer shoulder 210A and the second outer shoulder 210B. The first and second outer shoulders 210A, 210B provide a surface for mounting the first and second endcaps 206, as explained below in more detail.

The body casing 204 further includes a front lip 214 annularly extending from a peripheral edge of a front ledge 216 about the first opening 208A of the body casing 208. The front lip 214 and/or front ledge 216 define a front recess 218 to receive at least a portion of the insulation feature 118, as explained in more detail below. Further, a front surface 220A of the front lip 214 provides a grounding connection with the first endcap 206A and a back surface 220B of the body casing 204 provides a grounding connection with the second endcap 206B, as explained in more detail below. The body casing 204 further includes a back flange 222 inwardly extending toward a center of the body casing 204 at or proximate to the second opening 208B. Accordingly, the second opening 208B defined by the back flange 222 is smaller than the front opening 208A defined by the front lip 214. This allows for at least a portion of the insulation feature 118 to be inserted and secured within the body casing 204, as explain in more detail below.

The first endcap 206A defines a first opening 224A-1 at a first end (towards the female connector first end 200A), a second opening 224B-1 at a second end (towards the female connector second end 200B), and an interior 224C-1 therebetween. The first endcap 206A further includes a non-circular wall 226-1 (also referred to herein as an ovular wall) towards the first opening 224A-1 with a first peripheral end 228A-1, a circular wall 230-1 towards the second opening 224B-1 with a second peripheral end 228B-1, and an intermediate wall 232-1 positioned therebetween. The non-circular wall 226-1 makes up a portion of the non-circular interface 128, and, as mentioned above, is shown as oval, but other shapes may be used. At least a portion of the non-circular wall 226-1 is configured for insertion into the male connector 114 to orient the left and right spring interconnects 132A, 132B with the left and right conductor pins 130A, 130B of the male connector 114, as explained in more detail below. The first peripheral end 228A-1 of the non-circular wall 226-1 creates grounding contact with the male connector 114, as explained in more detail below.

The circular wall 230-1 is configured (e.g., sized and shaped) to fit over an end of the body casing 204. More specifically, the first opening 208A of the body casing 204A (and the first outer shoulder 210A thereof) is positioned within the second opening 224B-1 of the first endcap 206A. The second peripheral end 228B-1 of the first endcap 206A is then rolled, such as around the first outer shoulder 210A of the body casing 204 to attach the first endcap 206A to the body casing 204. Alternatively, or additionally, the first endcap 206A and the body casing 204 may be press fit into each other, such that the outer diameter of the body casing 204 is slightly larger than the inner diameter of the circular wall 226-1 of the first endcap 206A. When attached to one another, a grounding path is formed at least between the front surface 220 of the front lip 214 of the body casing 204 and an interior surface of the intermediate wall 232-1 of the first endcap 206A, and/or between the second peripheral end 228B-1 and the first outer shoulder 210A. Further, the circular wall 226-1 includes a top channel 234A-1 and a bottom channel 234B-1 (not shown), which are configured for engaging the retaining clip 134, as explained below in more detail.

The second endcap 206B defines a first opening 224A-2 at a first end (towards the female connector second end 200B), a second opening 224B-2 at a second end (towards the female connector first end 200A), and an interior 224C-2 therebetween. The second endcap 206B further includes a non-circular wall 226-2 (also referred to herein as an ovular wall) towards the first opening 224A-2 with a first peripheral end 228A-2, a circular wall 230-2 towards the second opening 224B-2 with a second peripheral end 228B-2, and an intermediate wall 232-2 positioned therebetween. The circular wall 230-2 is configured (e.g., sized and shaped) to fit over an end of the body casing 204. More specifically, the first opening 208A of the body casing 204A (and the first outer shoulder 210A thereof) is positioned within the second opening 224B-2 of the second endcap 206B. The second peripheral end 228B-2 of the second endcap 206B is then rolled, such as around the second outer shoulder 210B of the body casing 204 to attach the second endcap 206B to the body casing 204. Alternatively, or additionally, the second endcap 206B and the body casing 204 may be press fit into each other, such that the outer diameter of the body casing 204 is slightly larger than the inner diameter of the circular wall 226-2 of the second endcap 206B. When attached to one another, a grounding path is formed at least between the back surface 220B of the of the body casing 204 and an interior surface of the intermediate wall 232-2 of the second endcap 206B, and/or between the second peripheral end 228B-2 and the second outer shoulder 210B. Further, the circular wall 226-2 includes a top channel 234A-2 and a bottom channel 234B-2, which are configured for engaging the retaining clip 134, as explained below in more detail.

The insulation feature 118 is positioned within the housing 116 and defines a left channel 124A and a right channel 124B with at least a portion of the left and right conductors 126A, 126B of the cabling 110 positioned therein, as described in more detail below. The insulation feature includes a first dielectric 120 positioned towards the female connector first end 200A and a second dielectric 122 positioned towards the female connector second end 200B.

The first dielectric 120 further includes a non-circular body 236 (e.g., oval) configured to be positioned within the non-circular wall 226-1 of the first endcap 206A. The first dielectric 120 defines a left channel 238A and a right channel 238B parallel to the left channel 232A. In particular, each of the left and right channels 238A, 238B include a first opening 240A at a first end (towards the female connector first end 200A), a second opening 240B at a second end (towards the female connector second end 200B), and an interior 240C therebetween. Further the left and right channels 238A, 238B are configured to receive, respectively, the left and right spring-type interconnects 132A, 132B. As explained below in more detail, the left and right channels 238A, 238B are also configured to receive at least a portion of the left and right conductors 126A, 126B of the cabling 110 and to receive at least a portion of the left and right pins 130A, 130B of the male connector 114. As also explained in more detail below, to facilitate insertion and assembly, the first opening 240A of the left and right channels 232A includes a first chamfer 242A and the second opening 240B of the left and right channels 232A includes a second chamfer 242B.

The first dielectric 120 further includes an outer flange 244 at or proximate the second openings 132B. The outer flange 244 is non-circular shaped (e.g., oval shaped), but could be circular or any other shape. The outer flange 244 is sized and/or shaped to have a larger width than an interior diameter of the non-circular wall 226-1 of the first endcap 206A and a smaller width than an interior diameter of an interior of the front lip 214 of the body casing 204 for mounting therebetween. It is noted that the circular shape of the front lip 214 allows any relative rotational mounting of the outer flange 240 to the body casing 204 within the front lip 214 of the body casing 204.

The second dielectric 122 includes a cylindrical body 246 configured for insertion in the interior 208C of the body casing 204. The second dielectric 122 defines a left channel 248A and a right channel 248B parallel to the left channel 248A. In particular, the left and right channels 248A, 248B each include a first opening 250A at a first end (towards the female connector first end 200A), a second opening 250B at a second end (towards the female connector second end 200B), and an interior 250C therebetween. As explained below in more detail, the left channel 248A and the right channel 248B are configured to receive at least a portion of the cabling 110. As also explained in more detail below, to facilitate insertion and assembly, the second opening 250B of the left and right channels 246A, 246B include a chamfer 252. Further, the second dielectric 122 includes a top notch 254A (also referred to herein as a step, flat, etc.) and a bottom notch 254B proximate the second end of the second dielectric 122 to facilitate orientation of the second dielectric 122 within the body casing 204. In particular the top notch 254A and the bottom notch 254B identify which end of the second dielectric 122 includes the chamfer 252. The chamfer 252 facilitates insertion of the first and second conductors 126 and is only provided at one end for manufacturing and assembly purposes.

It is noted that when assembled, the left and right channel 238A, 238B of the first dielectric 120 rotationally align with the first and second channels 248A, 248B of the second dielectric 122. In this way, the left and right channels 124A, 124B of the insulation feature 118 comprise the left and right channels 238A, 238B of the first dielectric 120 and the left and right channels 248A, 248 of the second dielectric 122.

The retaining clip 134 includes a cylindrical shell 256 defining a channel 258 therein. The cylindrical shell 256 includes a front top tab 260A-1 and a front bottom tab 260A-2 proximate the first end of the cylindrical shell 256. The cylindrical shell 256 also includes a back top tab 260B-1 a back bottom tab 260B-2 proximate the second end of the cylindrical shell 256. The tabs 260A-1 to 260B-2 are configured to be inserted into the channels 234A-1 to 234B-2 of the first and second endcaps 206A, 206B. This prevents rotation of the retaining clip 134 relative to the housing 116.

The retaining clip 134 further includes a living hinge 262 extending from a top of the cylindrical shell 256. The retaining clip 134 further includes a lever 264 attached to a top of the living hinge 262, such that the living hinge 262 is positioned between the cylindrical shell 256 and the lever 264. The lever 264 includes a forwardly extending lever arm 136 and a rearwardly extending push tab 266, such that the living hinge 262 is positioned between the lever arm 136 and the push tab 266. At a forward end of the lever arm 136 is a prong 268 downwardly extending from the lever arm 136. The prong 268 includes a taper 269 at a front thereof to facilitate engagement of the lever arm 136 with the male connector 114. In some embodiments, the retaining clip 134 is made of plastic where the cylindrical shell 256 and lever 264 (including the lever arm 136, prong 268, and the push tab 266) are integrally formed. Accordingly, pushing downwardly on the push tab 266 forces the push tab 266 closer to the housing 116, which forces the prong 268 of the lever arm 136 away from the housing 116. Thus, the lever arm 136 is biased towards an engaged orientation (also referred to herein as a closed orientation), when no force is placed upon the push tab 266. The lever arm 136 is movable towards a disengaged orientation (also referred to herein as an open orientation), when force is placed upon the push tab 266.

As mentioned above, the left and right spring-type interconnects 132A, 132B are positioned within the left and right channels 238A, 238B of the first dielectric 120, between the first and second openings 240A, 240B. Each of the left and right spring-type interconnects 132A, 132B includes a first end 270A (positioned towards the first end 200A) and a second end 270B (positioned towards the second end 200B) opposite the first end 270A. Cabling 110 includes left and right conductors 126A, 126B positioned within left and right channels 272A, 272B of a cabling dielectric 274, which is itself positioned within a jacket 276. At least a portion of the left and right conductors 126A, 126B extends from within the jacket 276 of the cabling 110 through the second endcap 206B (e.g., first opening 224A-2, second opening 224B-2, and interior 224C-2), through the second dielectric 122 (e.g., the left and right channels 248A, 248B), and through at least the second opening 240B of the first dielectric 120 (and as a result through the second opening 224B-1 of the first endcap 206A). In this way, ends of the first and second conductors 126A, 126B contact and are in electrical communication with the first and second spring-type interconnects 132A, 132B. Further, when the female connector 108 engages the male connector 114, the left and right conductor pins 130A, 130B of the male connect 114 contact and establish electrical communication with the first end 270A of the spring-type interconnects 132A, 132B. The spring-type interconnects 132A, 132B are compressed between the left and right conductors 126A, 126B of the cabling 110 and the left and right pins 130A, 130B of the male connector 114 to absorb tolerances and ensure a solid electrical connection between the left and right conductor pins 130A, 130B and the left and right conductors 126A, 126B of the cabling 110. Ends of the first and second conductors 126A, 126B may be made to contact that the first and second spring-type interconnects 132A, 132B within the first endcap 206A, but may also be made to contact each other at any point within the housing 116. However, it may be advantageous to shorten the length of the first and second spring-type interconnects 132A, 132B for reasons of electrical performance.

There are a variety of ways to assemble the cable assembly 102. One such way is to insert the left and right spring-type interconnects 132 within the left and right channels 238 of the first dielectric 120. Then the second dielectric 122 is inserted through the first opening 208A of the body casing 204, where the second dielectric 122 cannot exit through the second opening 208B because the diameter of the second dielectric 122 is larger than the second opening 208B. The first dielectric is inserted through the second opening 224B-1 of the first endcap 206A, where the outer flange 244 of the first dielectric 120 is larger than inner diameter of the non-circular wall 226 (and first opening 224A-1) of the first endcap 206A. The circular wall 230-1 of the first endcap 206A is then positioned over the first opening 208A of the body casing 204, and the second peripheral end 228B-1 of the first endcap 206A is rolled around the first outer shoulder 210A of the body casing 204. In this way, the first endcap 206A is secured to the housing body 112. The cylindrical shell 256 of the retaining clip 134 is then slid over the second opening 208B of the body casing 204 and the cylindrical shell 256 is positioned around the recessed center portion 212 of the body casing 204, such that the first and second tabs 260A-1, 260B-1 are positioned within top and bottom channels 234A-1, 234B-1 of the first endcap 206A. The circular wall 230-2 of the second endcap 206B is then slid over the second opening 208B of the body casing 204, and the back top and bottom tabs 260A-2, 260B-2 of the retaining clip 134 are then positioned within the first and second channels 234A-2, 234B-2 of the second endcap 206B. The second peripheral end 228B-2 of the second endcap 206B is then rolled around the second outer shoulder 210B of the body casing 204. Accordingly, the cylindrical shell 256 of the retaining clip 134 is retained between the first and second endcaps 206A, 206B. Left and right conductors 126A, 126B are then fed through the left and right channels 248A, 248B of the second dielectric 122 into the left and right channels 238A, 238B of the first dielectric 120 until they contact the second ends 270B of the first and second spring-type interconnects 132.

Figure 3A:
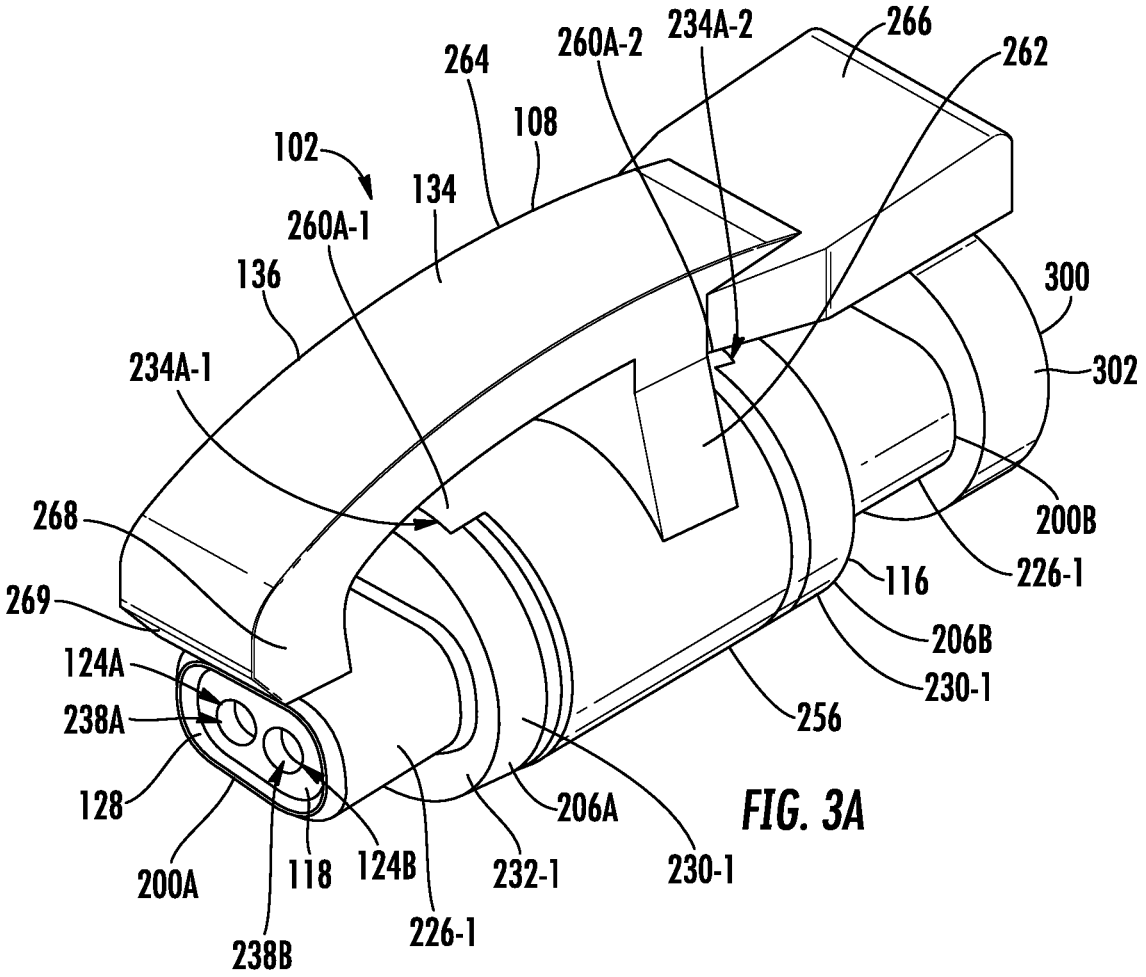
FIG. 3A is a perspective view of the female connector of the cable assembly of FIG. 1A with a plug inserted into the female connector.
Figure 3B:
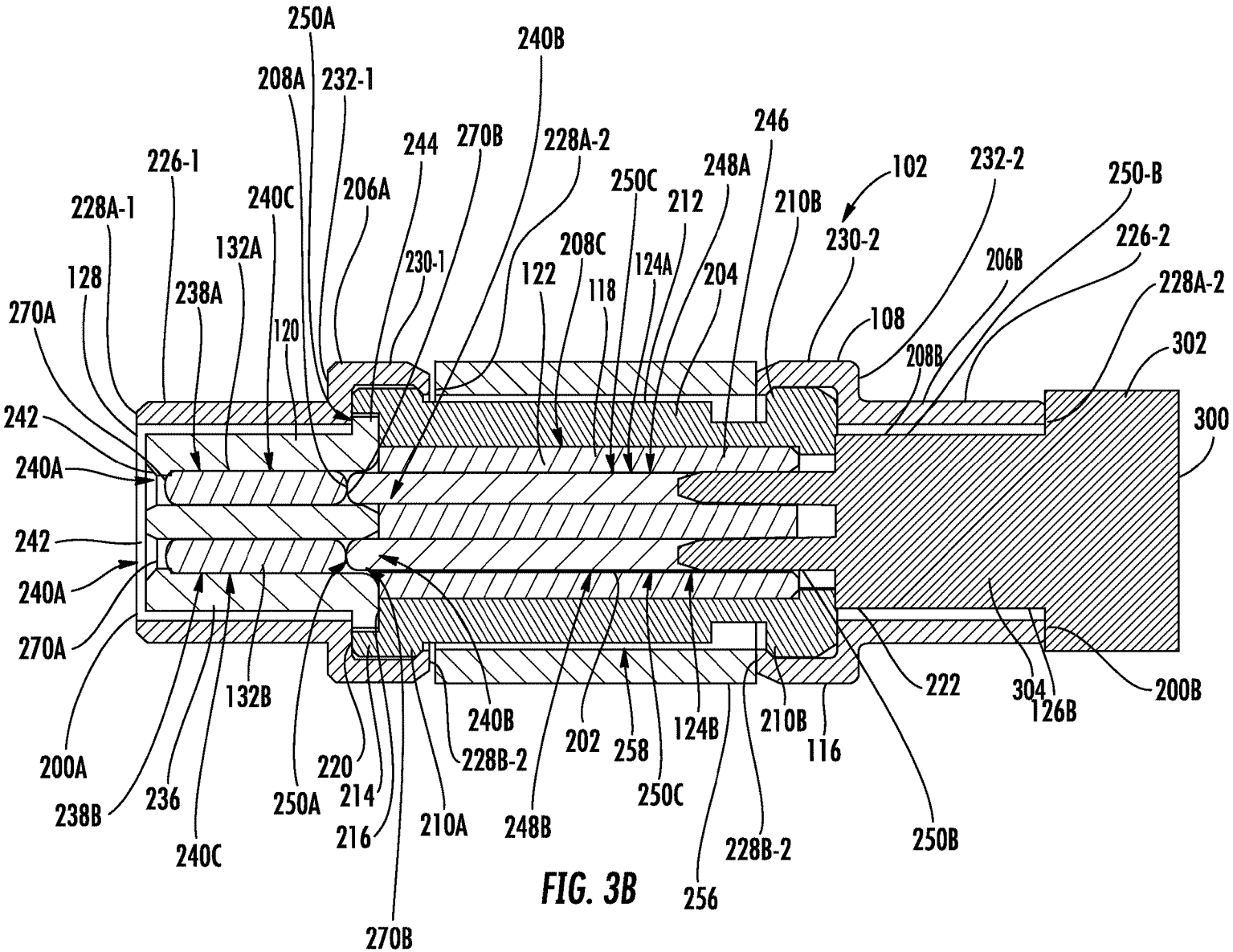
FIG. 3B is a cross-sectional view of the female connector and plug of FIG. 3A.
Figure 3C:
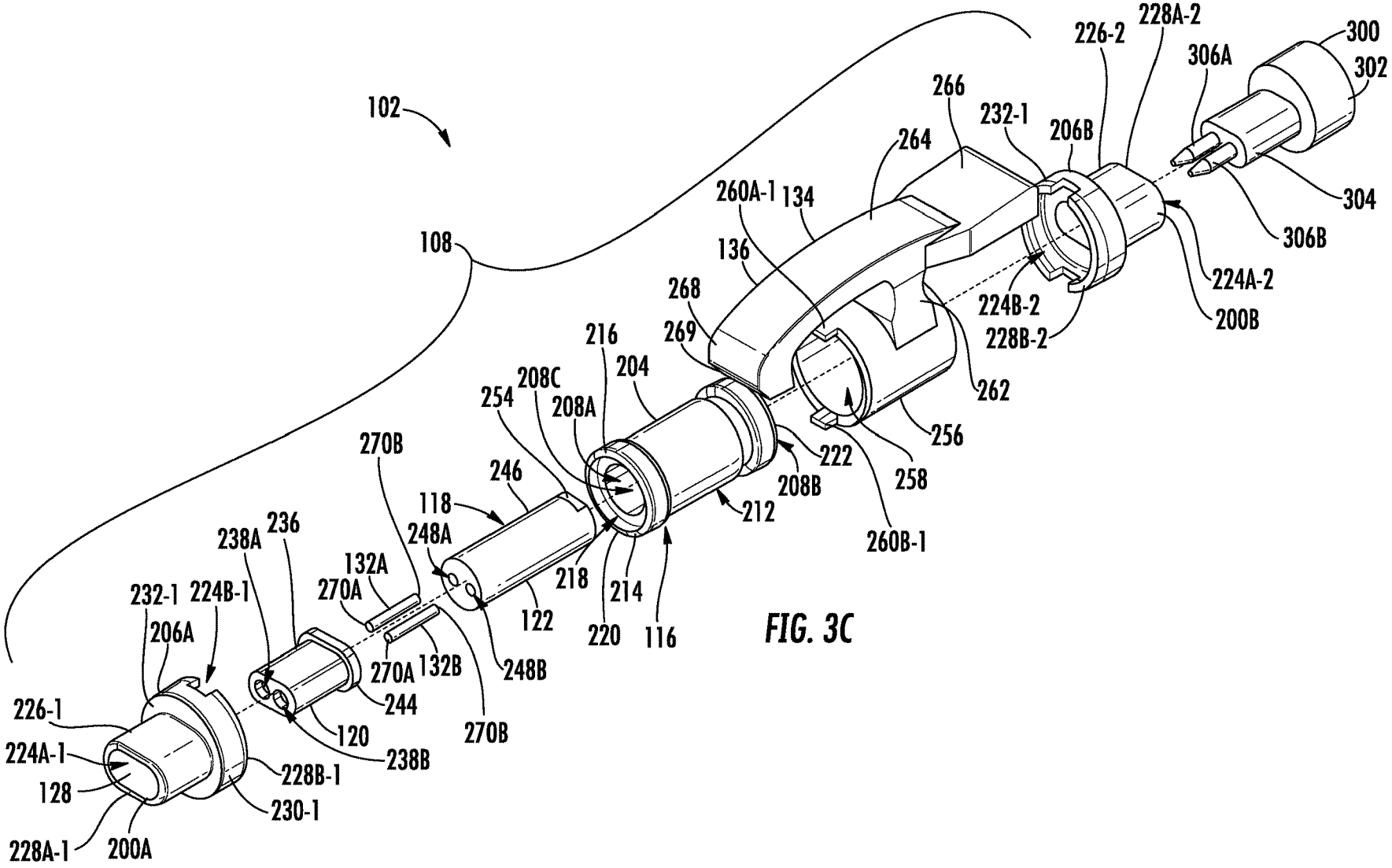
FIG. 3C is an exploded perspective view of the female connector and plug of FIG. 3A.

FIGS. 3A-3C are views of the female connector of the cable assembly of FIG. 1A with a plug inserted into the female connector. The plug 300 comprises a base 302 with a column 304 extending from the base 302, and with a left prong 306A and a right prong 306B extending from the column 304. The left prong 306A and the right prong 306B extend parallel to and in the same direction as each other. The plug 300 is insertable into and removable from the female connector 108. When the plug 300 is attached to the female connector 108, at least a portion of the left and right prongs 306A, 306B are inserted into the second openings 250B of the left and right channels 248A, 248B of the second dielectric 122, at least a portion of the column 304 is positioned within the non-circular wall 226-2 of the second endcap 206B. In this way, the female connector 108 can be assembled and shipped to another location for assembly with the cabling 110.

FIGS. 4A-4H are views of a first embodiment of the block assembly of FIGS. 1A and 1C. The block assembly 104 includes a housing 112 and a plurality of male connectors 114-1 to 114-8 included therein. Although eight male connectors 114-1 to 114-8 are shown, more or fewer male connectors may be used (e.g., one, two, three, four, 5, 6, 7, 9, 10, 11, 12, etc.). It is noted that although a block assembly 104 is shown, instead a single port housing could be used. As mentioned above, each of the male connectors 114 are configured to selectively mechanically engage and electrically connect with female connectors 108. Each of the male connectors 114 includes a body 400 with a first mating interface 402A at a front of the body 400 (e.g., at the front of the housing 112) and a second mating interface 402B at a bottom of the body 400 (e.g., at the bottom of the housing 112). Together, the bodies 400 of the male connectors 114 are integrally connected with one another to form the block assembly housing 112. Further, each of the male connectors 114 includes an insulation feature 404 positioned within the body 400 and electrical connections 406 positioned within the insulation feature 404 (and the body 400).

Referring to FIGS. 4A-4E, the housing 112 includes a left bottom post 408A downwardly extending from a bottom surface of the housing 112 at or proximate a left side of the housing 112. Similarly, the housing 112 further includes a right bottom post 408B downwardly extending from a bottom surface of the housing body 112 at or proximate a right side of the housing body 112. The left bottom post 408A and the right bottom post 408B can be used to mount the block assembly 104 to the printed circuit board 106.

Although a single male connector 114 is described in detail below, it will be appreciated that the features described apply to each male connector 114. The body 400 defines a first opening 409A at a front surface of the body 400, a second opening 409B at a bottom of the body 400, and an interior 409C therebetween. The male connector 114 includes a bottom slot 410 at a bottom of the body 400 extending through a back surface of the body 400. The bottom slot 410 provides access for electrical connections 406 of the male connector 114 to exit the body 400 for wiring to the printed circuit board 106.

The male connector 114 includes a port 412 extending inwardly from the front surface of the housing body 112 to an internal shelf 414. The port 412 is non-circular (e.g., ovular) in shape (although other shapes may be used) and corresponds in size and shape to the first endcap 206A of the female connector 108 to receive at least a portion of the first endcap 206A within the port 412, as explained in more detail below. Further the port 412 includes tapered walls 413 to facilitate alignment of the female connector 108 and male connector 114. The internal shelf 414 defines a first circular recess 416A and a second circular recess 416B smaller in diameter than the first circular recess 416A, as explained below in more detail. The male connector 114 defines a vertical conduit 418 upwardly extending from the bottom of the body 400. The recesses 416A, 416B and vertical conduit 418 provide access to electrical connections 406 of the male connector 114 for electrical connection with the female connector 108.

The body 400 defines an upper flange 422 at or proximate to a front surface and extending from a top surface of the body 400. As explained in more detail below, the upper flange 422 of the block assembly 104 provides mechanical engagement with the retaining clip 134 of the female connector 108 (in FIGS. 1A-3C). The upper flange 422 includes a taper 424 to facilitate engagement of the male connector 114 with the retaining clip 134 of the female connector 108.

The insulation feature 404 receives the electrical connections 406 therein. In particular, the insulation feature 404 includes a first dielectric 426 positioned within the second circular recess 416B of the body 400 and a second dielectric 428 press fit into the vertical conduit 418. The first dielectric 426 and the second dielectric 428 mount the electrical connections 406 within the body 400. In particular, the first dielectric 426 defines a left channel 430A and a right channel 430B adjacent and parallel to the left channel 430A. Each of the channels 430A, 430B defines a first opening 432A and a second opening 432B (opposite the first opening 432A) with an interior 432C positioned therebetween. The second opening 432B includes a chamfer 434 at or proximate the second opening 432B to facilitate insertion of electrical connections 406 into the left channel 430A and the right channel 430B. The first dielectric 426 also includes one or more notches 436 in an external surface of the first dielectric 426 at or proximate the bottom opening 432B to easily visually indicate to a user the proper orientation of the first dielectric 426 and corresponding chamfer 434 relative to the body 400 when assembling the first dielectric 426 within the body 400. The first dielectric 426 is circular but could be non-circular (e.g., oval) and is configured to be slip fit into the body 400 for ease of manufacturing.

Referring to FIGS. 4F-4J, the second dielectric 428 includes a circular portion 438 and a rectangular portion 440 extending from a periphery of the circular portion 438. The circular portion 438 includes a lower portion 442 and an upper portion 444, where the upper portion 444 is a smaller diameter than the lower portion 442. The height of the rectangular portion 440 extends from a bottom surface of the second dielectric 428 upward to about the bottom of the upper portion 444. In this way, the upper portion 444 of the circular portion 438 has a circular periphery, thereby allowing the upper portion 444 of the second dielectric 428 to be press fit into the bottom circular recess 411 of the male connector 114. In this way, the rectangular portion 440 of the second dielectric 428 is positioned within the bottom through slot 410. Accordingly, the rectangular portion 440 provides structure to the electrical connections 406 (explained below in more detail) and also prevents any accidental or inadvertent rotation of the second dielectric 428 within the body 400.

The second dielectric 426 further defines a left vertical channel 446A and a right vertical channel 446B upwardly extending from a bottom surface of the second dielectric 426 and extending from a back surface of the rectangular portion 440 through the rectangular portion 440 and through at least a portion of the circular portion 438. The second dielectric 428 further defines a left horizontal channel 448A and a right horizontal channel 448B extending from a top surface and from a front surface of the circular portion 438 of the second dielectric 426. The left and right horizontal channels 448A, 448B help orient the left and right conductor pins 130A, 130B, particularly during assembly. Also, the left and right horizontal channels 448A, 448B may be configured for electrical purposes, such as to alter induction or impedance. The left vertical channel 446A intersects the left horizontal channel 448A, and the right vertical channel 446B intersects the right horizontal channel 448B. In this way, the left horizontal channel 448A, the right horizontal channel 448B, the left vertical channel 446A and the right vertical channel 446B are configured to receive at least a portion of the electrical connections 406 to mount the electrical connections 406 within the second dielectric 428 and to mount the electrical connections 406 within the body 400 of the male connector 114.

Referring to FIGS. 4B-4E, the electrical connections 406 include a left conductor pin 450A and a right conductor pin 450B and a bushing 452 (e.g., snap ring). Each of the left conductor pin 450A and the right conductor pin 450B includes a first leg 454 and a second leg 456 perpendicular to the first leg 454, and a third leg 458, perpendicular to the second leg 456 and parallel and offset to the first leg 454. Accordingly, each conductor pin 450A, 450B includes a first end 460A at the first leg 454 and a second end 460B at the second leg 456.

The first leg 454 of the left and right conductor pins 450A, 450B is positioned within and extends through the left and right channels 430A, 430B of the first dielectric 426. In this way, the first leg 454 of the left conductor pin 450A extends into the port 412 of the body 400 of the male connector 114, providing for the left conductor pin 450A to engage the female connector 108. The second leg 456 of the left and right conductor pins 450A, 450B is positioned within and vertically extends through the left and right vertical channel 446A, 446B of the second dielectric 428. The third leg 458 of the left and right conductor pins 450A, 450B is positioned within and horizontally extends through the left and right vertical channels 446A, 446B at a bottom of the second dielectric 428 through the bottom slot 410 of the body 400.

Figure 4A:
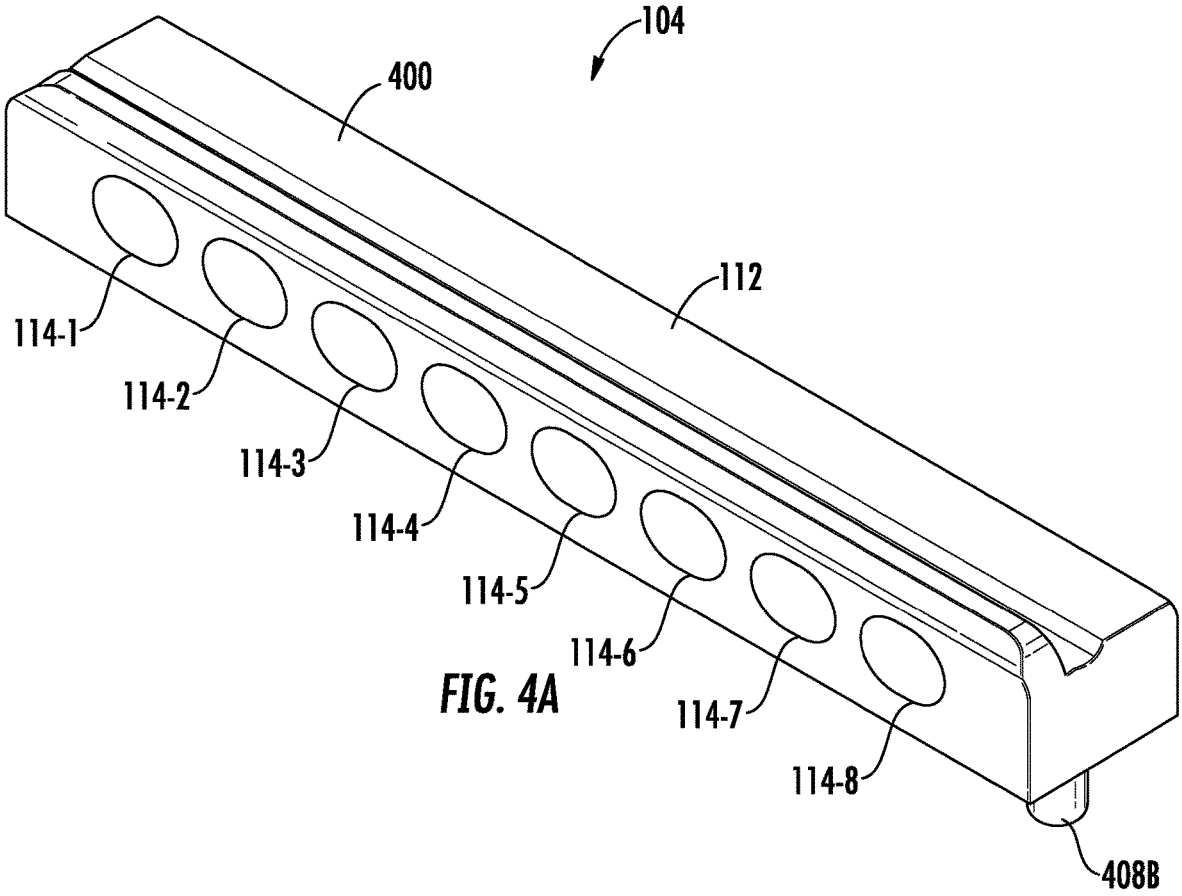
FIG. 4A is a front perspective view of a first embodiment of the block assembly of FIGS. 1A and 1C.
Figure 4B:
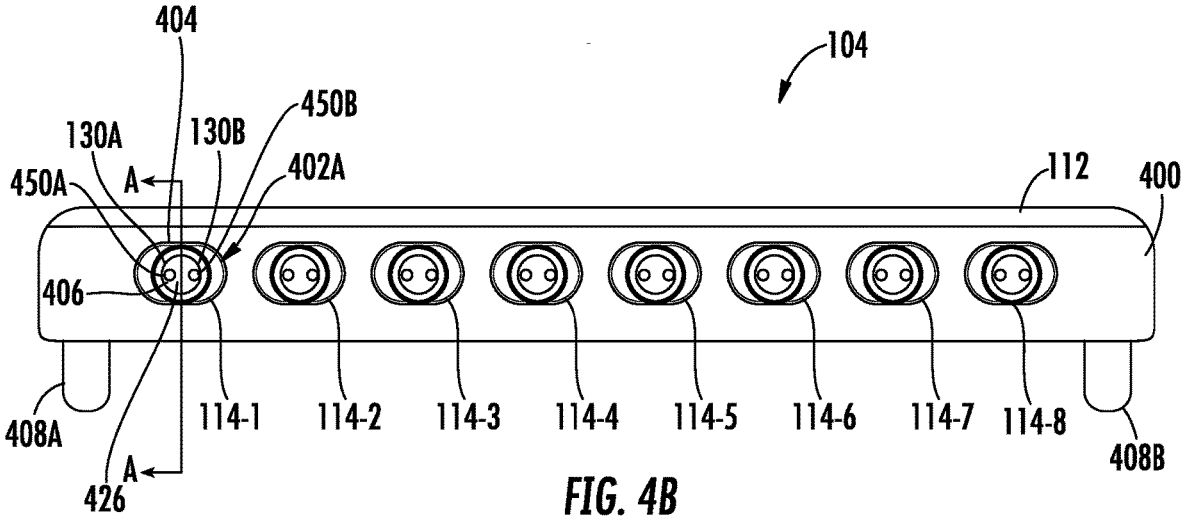
FIG. 4B is a front view of the block assembly of FIG. 4A.
Figure 4C:
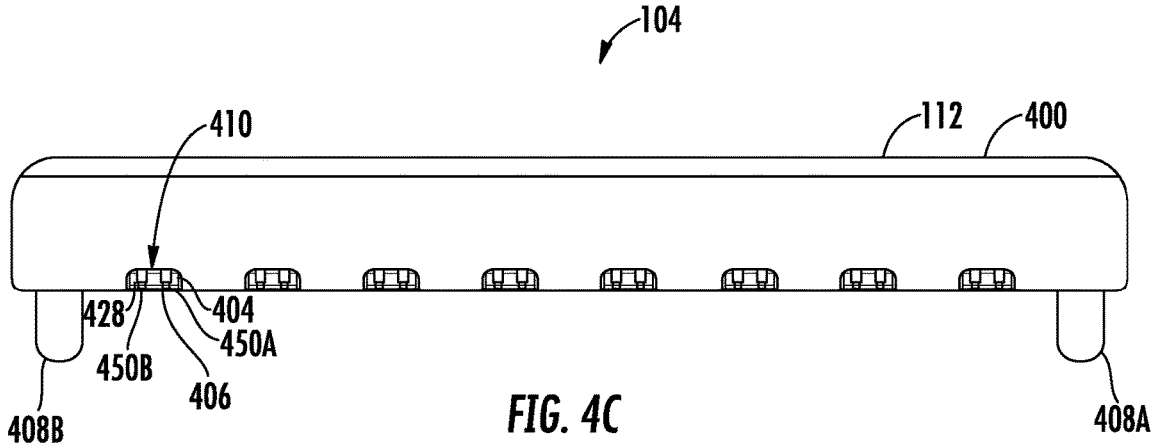
FIG. 4C is a back view of the block assembly of FIG. 4A.
Figure 4D:
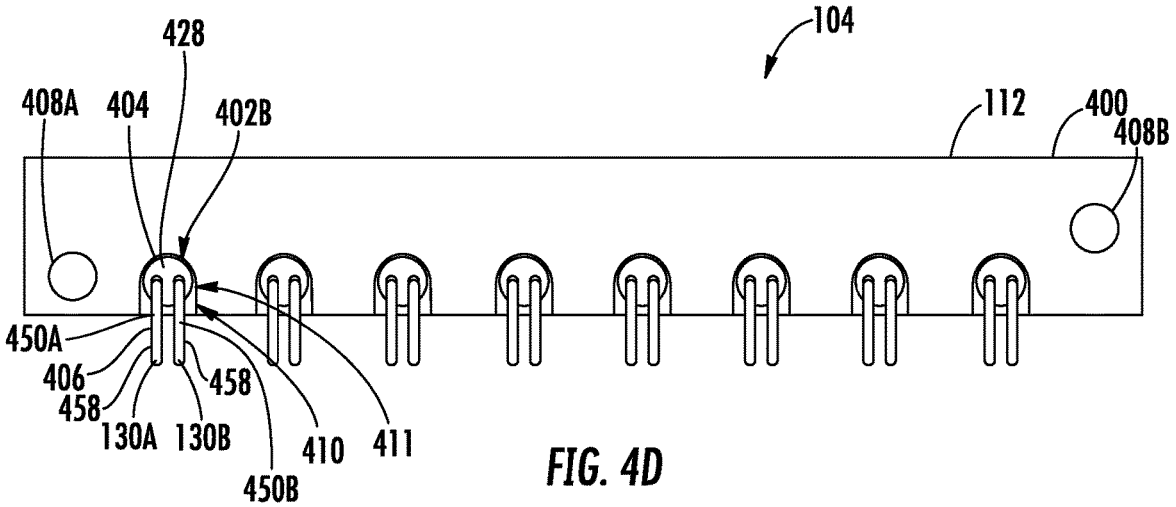
FIG. 4D is a bottom view of the block assembly of FIG. 4A.
Figure 4E:
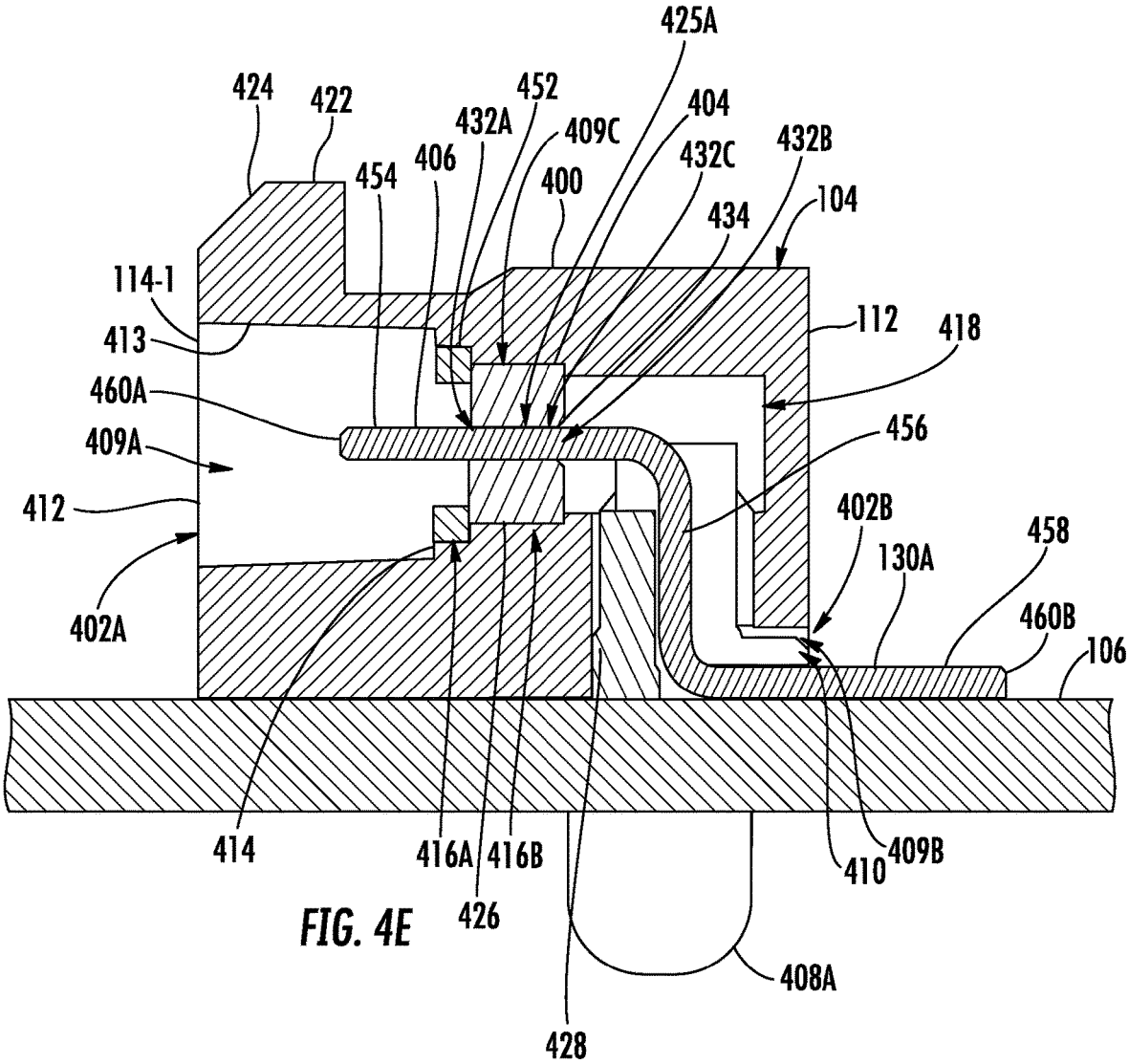
FIG. 4E is a cross-sectional side view of the block assembly of FIG. 4A.
Figure 4F:
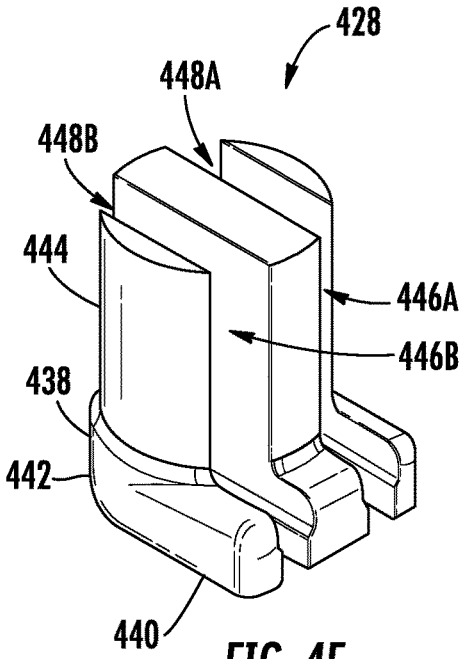
FIG. 4F is a top front perspective view of a bottom dielectric of the block assembly of FIG. 4A.
Figure 4G:
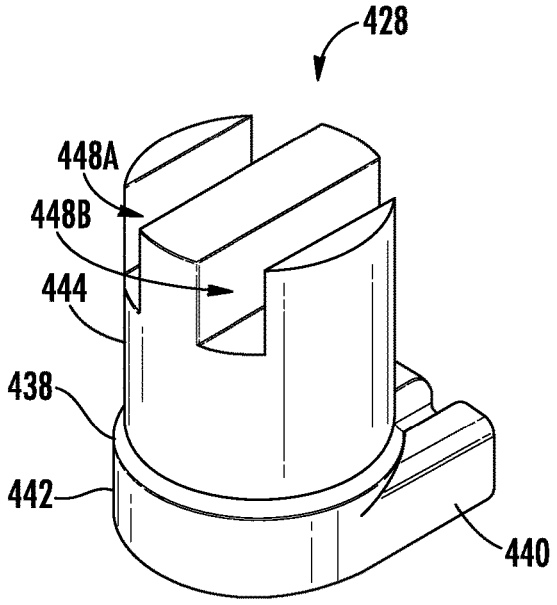
FIG. 4G is a top back perspective view of the bottom dielectric of FIG. 4F.
Figure 4H:
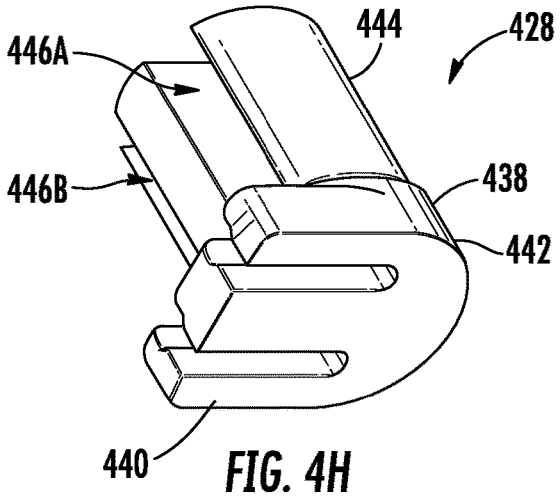
FIG. 4H is a bottom front perspective view of the bottom dielectric of FIG. 4F.
Figure 4I:
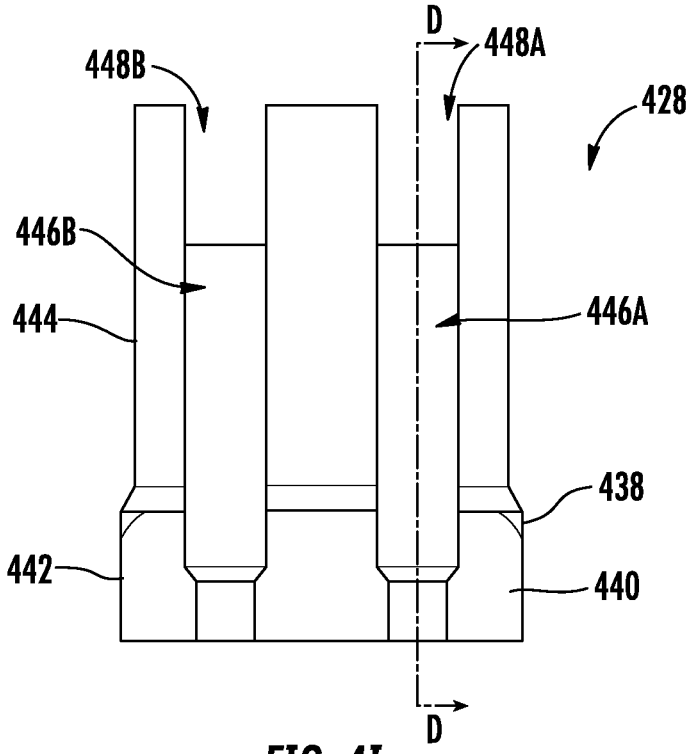
FIG. 4I is a front view of the bottom dielectric of FIG. 4F.
Figure 4J:
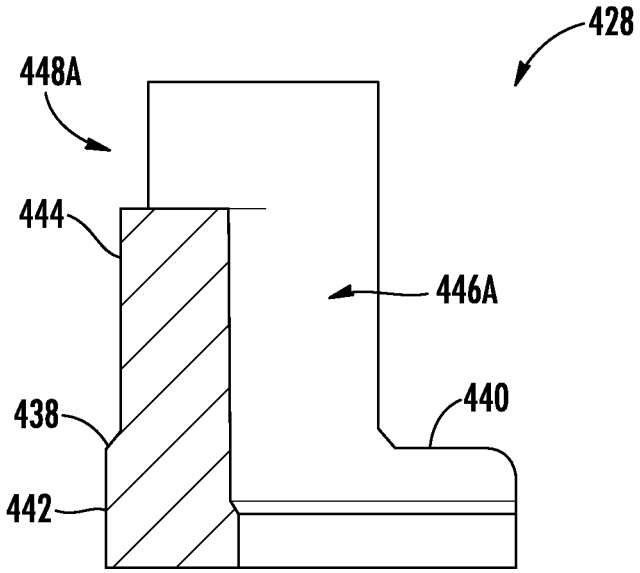
FIG. 4J is a cross-sectional side view of the bottom dielectric of FIG. 4F taken along line D-D of FIG. 4I.
Figure 4K:
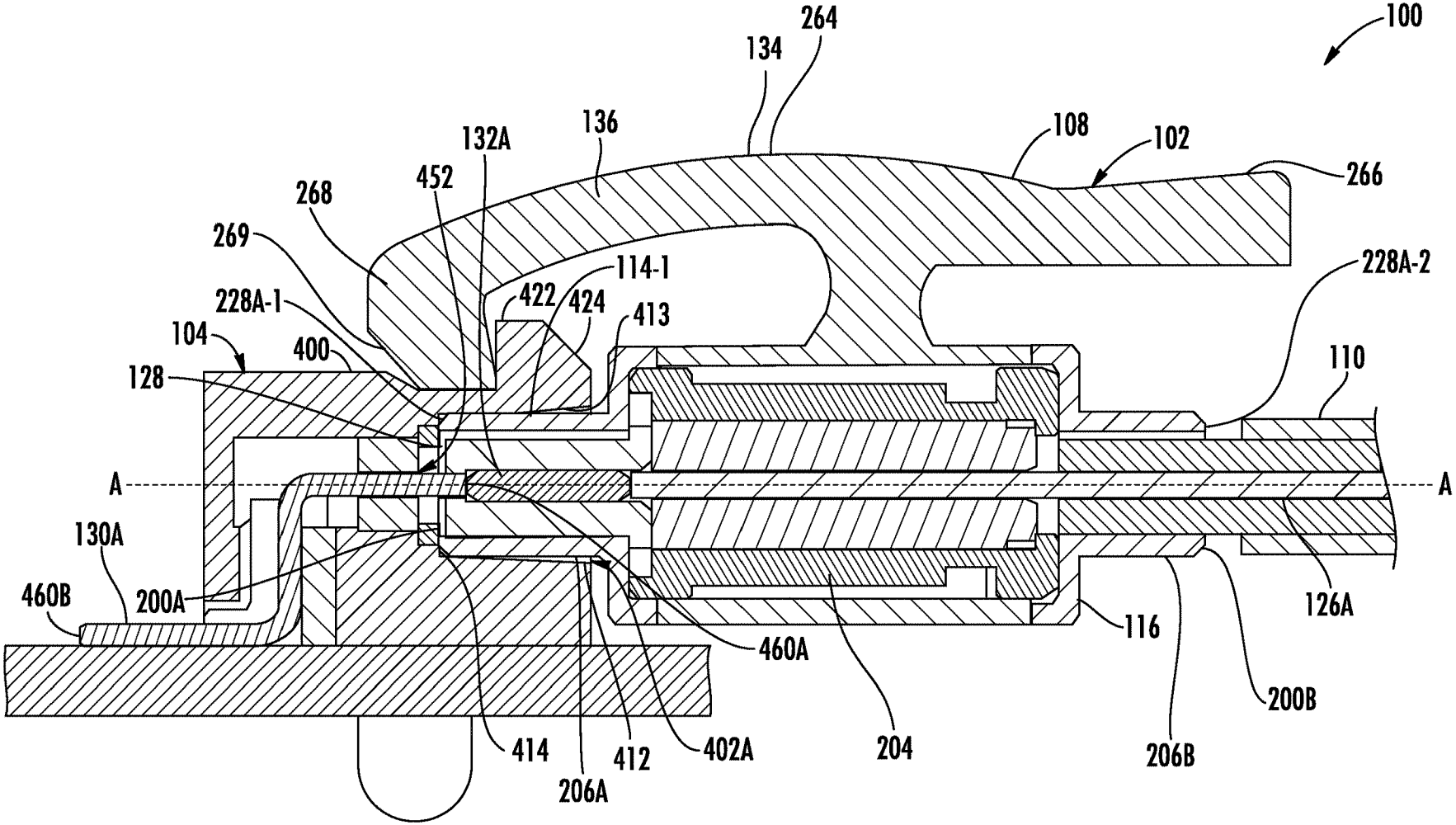
FIG. 4K is a cross-sectional side view of the cable assembly of FIGS. 1A-1B and 2A-2C and the block assembly of FIGS. 1A, 1C, and 4A-4E.

FIG. 4K is a cross-sectional side view of the cable assembly of FIGS. 1A-1B and 2A-2C and the block assembly of FIGS. 1A, 1C, and 4A-4D. To connect the female connector 108 to the male connector 114-1, the first peripheral end 228A-1 of the first endcap 206A into the port 412 of the male connector 114-1 of the block assembly 104. Due to the corresponding geometries of the non-circular interface 128 of the female connector 108 and the mating interface 402A of the male connector 114-1, the first endcap 206A of the female connector 108 can only be inserted into the port 412 of the male connector 114 if the two are appropriately aligned. Once the first endcap 206A is at least partially inserted into the port 412, the left and right spring contact interconnects 132A, 132B of the female connector 108 and the left and right conductors 126 of the cabling 110 are aligned with the first ends 460A of the left and right conductor pins 130A, 130B of the male connector 114. As the female connector 108 is further inserted into the male connector 114, the tapered walls 413 of the port 412 further guide alignment of the left and right spring contact interconnects 132A, 132B of the female connector 108 and the left and right conductors 126 of the cabling 110 with the first ends 460A of the left and right conductor pins 130A, 130B of the male connector 114. Once the female connector 108 and the male connector 114 are fully engaged, the first peripheral end 228A-1 of the first endcap 206A is in contact with the bushing 452 and/or the internal shelf 414 of the male connector 114, thereby establishing a grounding path from the body 400 of the male connector 114 through the bushing 452 and/or internal shelf 414, to the first peripheral end 228A-1 of the first endcap 206A, through the body casing 204, and through the second endcap 206A.

Once fully engaged, the first end 460A of the left and right conductor pins 130A, 130B of the male connector 114 are in contact (and slightly compress) with the left and right spring-type interconnects 132A, 132B of the female connector 108, as the left and right spring-type interconnects 132A, 132B of the female connector 108 are compressed between the left and right conductor pins 130A, 130B of the male connector 114 and the left and right conductors 126A, 126B of the female connector 108. Thus, an electrical connection is established between the female connector 108 and the male connector 114, without any need for soldering.

With respect to mechanical engagement of the female connector 108 and the male connector 114, as the female connector 108 is axially inserted into the male connector 114 (as described above), the taper 269 of the prong 268 of the lever arm 136 of the retaining clip 134 of the female connector 108 contacts the taper 424 of the upper flange 422 of the body 400 of the male connector 114. As the female connector 108 continues to be inserted, the taper 269 of the female connector 108 and the taper 424 of the male connector 114 work together to force the prong 268 upwards and away from the housing 116 of the female connector 108 to a disengaged orientation. Once fully engaged, the prong 268 returns downward and toward the housing 116 to an engaged orientation. Accordingly, the female connector 108 cannot be disengaged from the male connector 114 without first pushing on the push tab 266 of the lever 264 to move the lever arm 136 to a disengaged orientation. Further, when fully engaged, the prong 268 is forced to flex forward, towards the first end 200A of the female connector 108. This tension forces the female connector 108 forward to maintain a solid grounding connection and compensate for tolerance differences between the first endcap 206A of the female connector 108 and the bushing 452 and/or internal shelf 414 of the body 400 of the male connector 114.

FIGS. 5A-5D are views of a first embodiment of the block assembly of FIGS. 1A and 1C. The block assembly is similar to that of FIGS. 4A-4F except where otherwise noted. In particular, referring to FIGS. 5A-5C, the block assembly 104 does not include a second recesses 416B or bushing 452. Instead, the internal shelf 414 defines only one circular recess 516. Recess 516 and vertical conduit 418 provide access to electrical connections 406 of the male connector 114 for electrical connection with the female connector 108. As noted above, the insulation feature 404 receives the electrical connections 406 therein. In particular, the insulation feature 404 includes a first dielectric 426 positioned within and press fit into the circular recess 516 of the body 400.

Figure 5A:
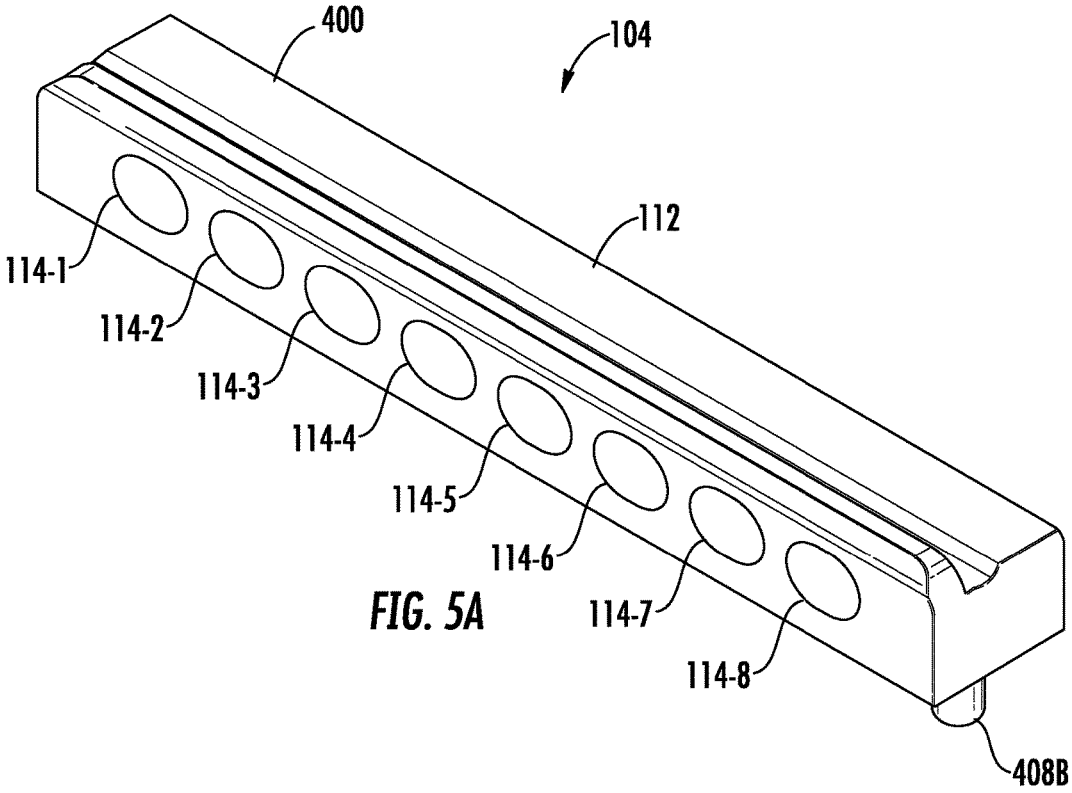
FIG. 5A is a front perspective view of a second embodiment of the block assembly of FIGS. 1A and 1C.
Figure 5B:
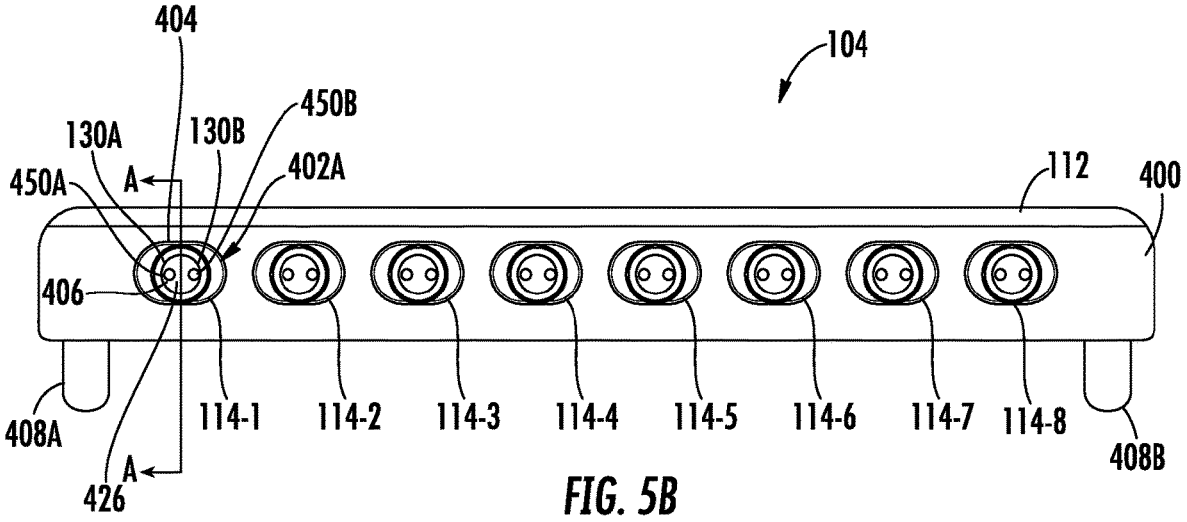
FIG. 5B is a front view of the block assembly of FIG. 5A.
Figure 5C:
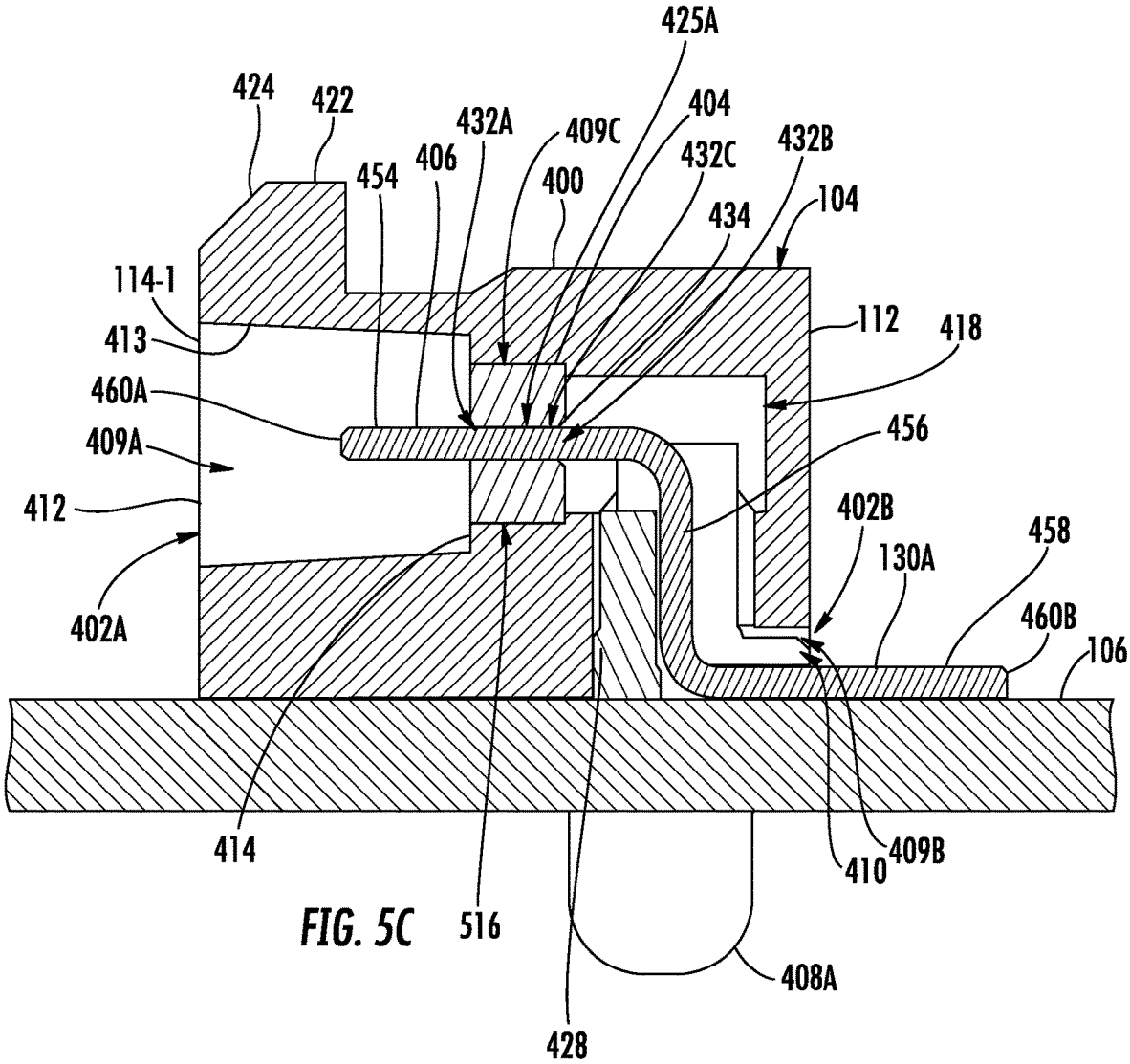
FIG. 5C is a cross-sectional side view of the block assembly of FIG. 5A.
Figure 5D:
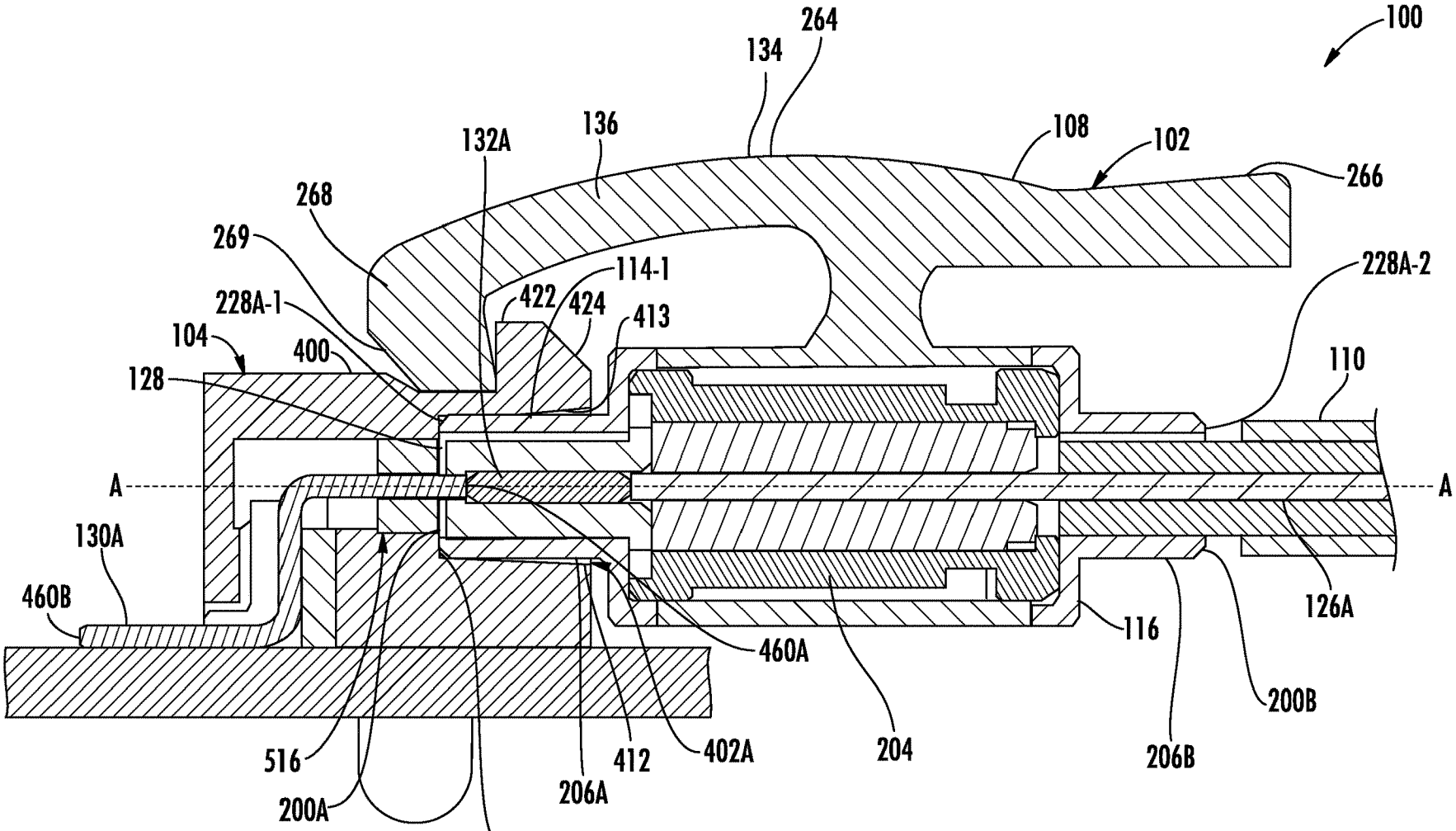
FIG. 5D is a cross-sectional side view of the cable assembly of FIGS. 1A-1B and 2A-2C and the block assembly of FIGS. 5A-5C.
Figure 6A:
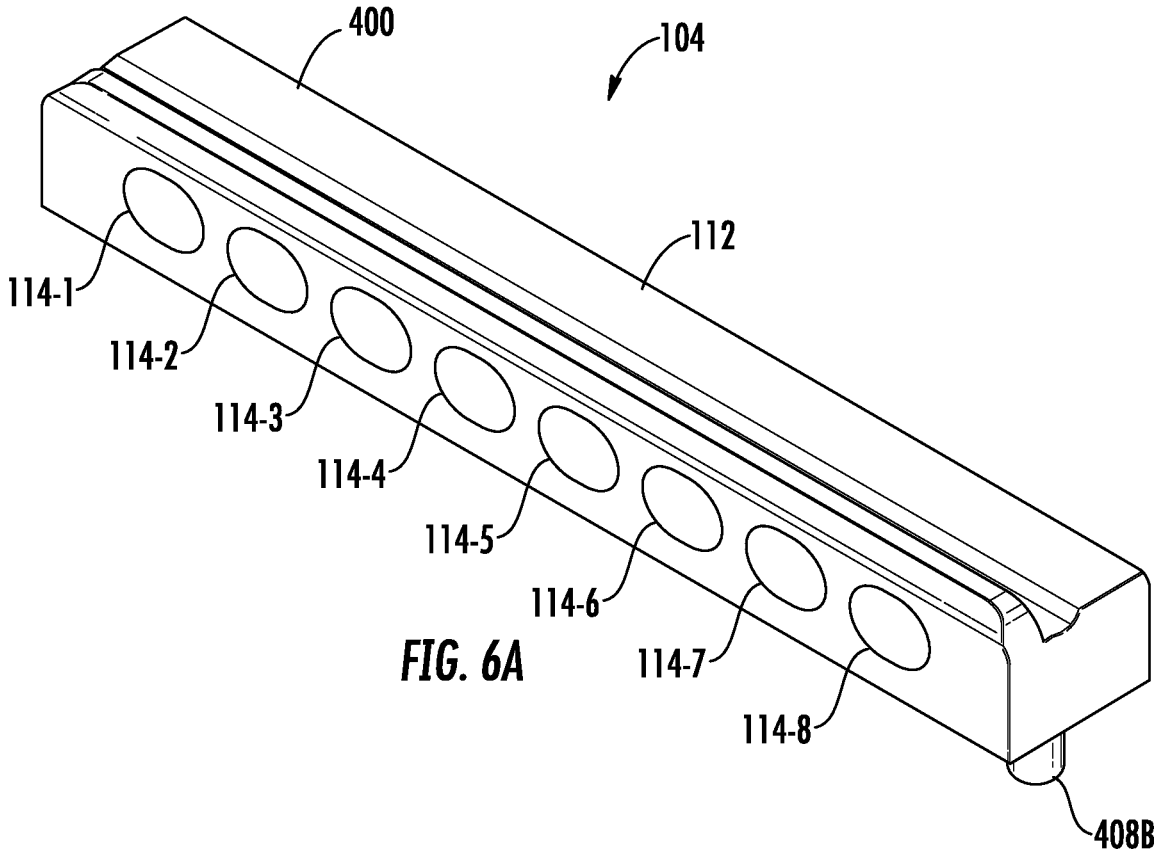
FIG. 6A is a front perspective view of a third embodiment of the block assembly of FIGS. 1A and 1C.
Figure 6B:
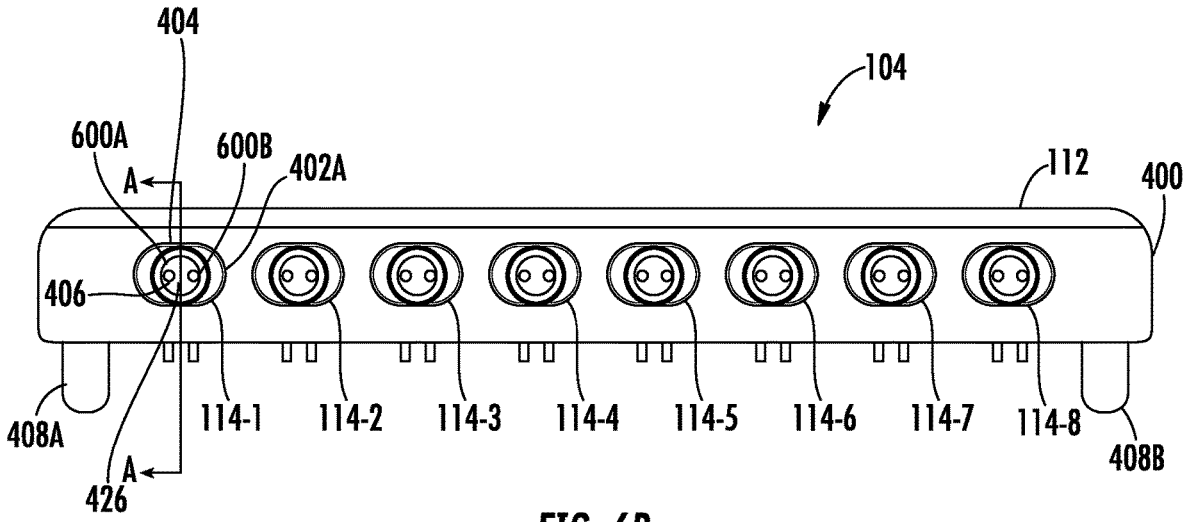
FIG. 6B is a front view of the block assembly of FIG. 6A.
Figure 6C:
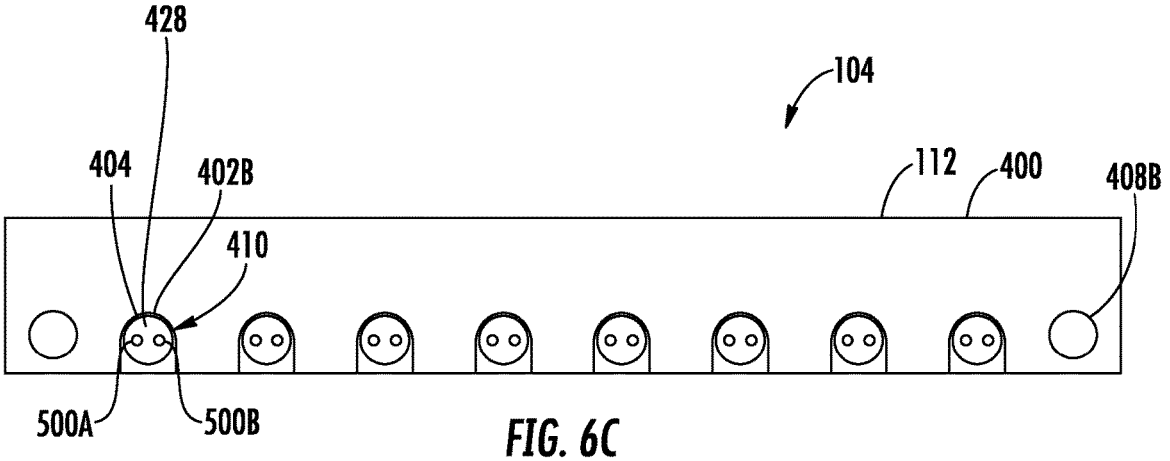
FIG. 6C is a bottom view of the block assembly of FIG. 6A.
Figure 6D:
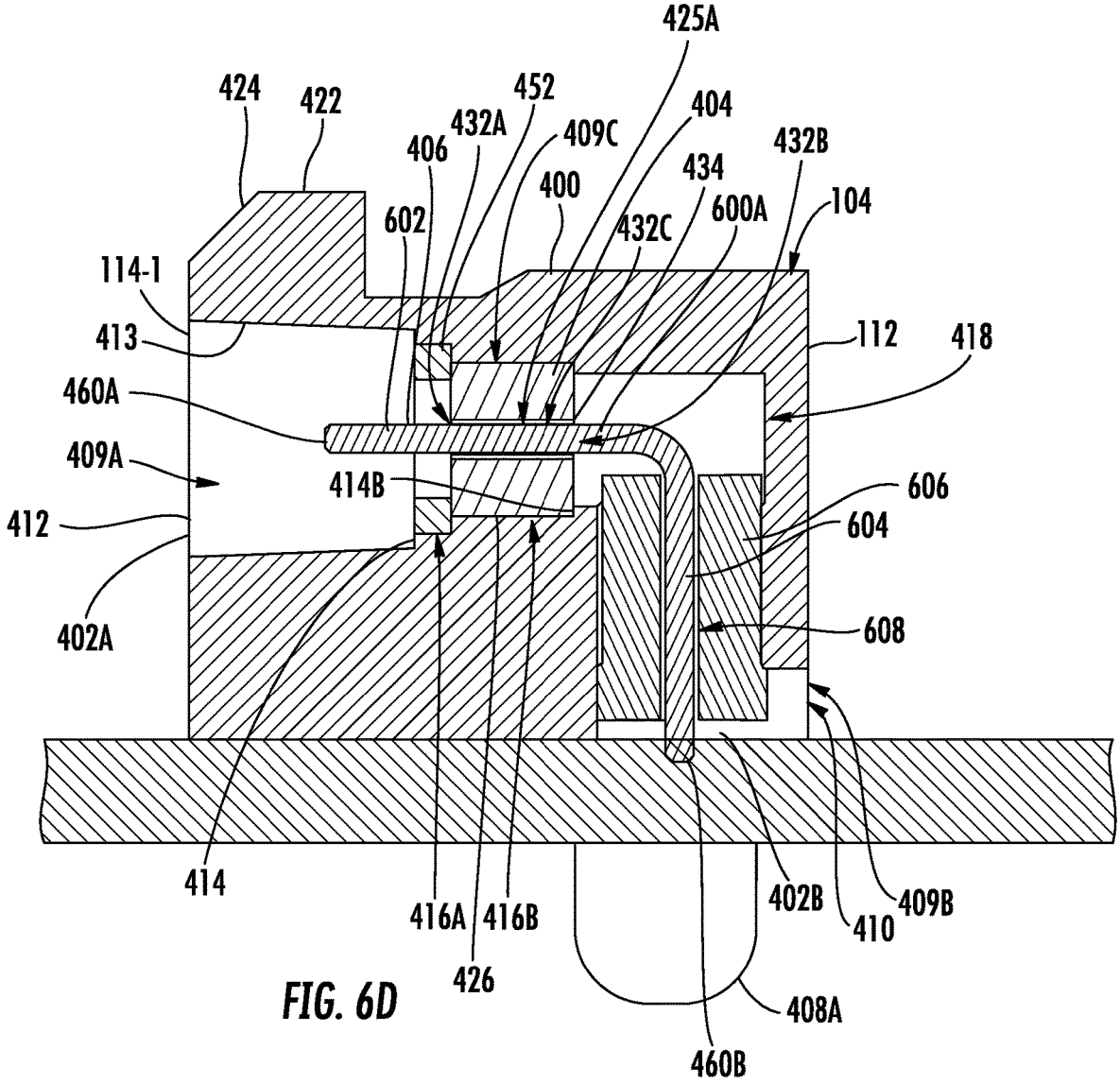
FIG. 6D is a cross-sectional side view of the block assembly of FIG. 6A.

FIG. 5D is a cross-sectional side view of the cable assembly 102 of FIGS. 1A-1B and 2A-2C and the block assembly 104 of FIGS. 1A, 1C, and 5A-5D. The cable assembly 102 and the block assembly 104 operate as similarly discussed with respect to FIG. 4K except where otherwise noted. In particular, once the female connector 108 and the male connector 114 are fully engaged, the first peripheral end 228A-1 of the first endcap 206A is in contact with the internal shelf 414 of the male connector 114, thereby establishing a grounding path from the body 400 of the male connector 114 through the internal shelf 414, to the first peripheral end 228A-1 of the first endcap 206A, through the body casing 204, and through the second endcap 206A. As noted above, when fully engaged, the prong 268 is forced to flex forward, towards the first end 200A of the female connector 108. This tension forces the female connector 108 forward to maintain a solid grounding connection and compensate for tolerance differences between the first endcap 206A of the female connector 108 and the internal shelf 414 of the body 400 of the male connector 114.

FIGS. 6A-6D are views of a third embodiment of the block assembly of FIGS. 1A and 1C. The block assembly is similar to that of FIGS. 4A-4F except where otherwise noted. In particular, the left and right conductor pins 600A, 600B only include a first leg 602 and a second leg 604 perpendicular to the first leg 602, where the first end 460A is at the end of the first leg 602 and the second end 460B is at the end of the second leg 604. Accordingly, the second dielectric 606 is cylindrical with a cylindrical channel 608 therethrough. In this way, the second dielectric 606 can be press fit into the vertical conduit 418 from the bottom of the body 400 as the second leg 456 is inserted into the channel 608.

FIGS. 7A-7H are views of a fourth embodiment of the block assembly of FIGS. 1A and 1C. The block assembly is similar to that of FIGS. 4A-4F except where otherwise noted. The block assembly 104 includes a housing 112 and a plurality of male connectors 114-1 to 114-8 included therein. Although eight male connectors 114-1 to 114-8 are shown, more or fewer male connectors may be used (e.g., one, two, three, four, 5, 6, 7, 9, 10, 11, 12, etc.). As mentioned above, each of the male connectors 114 is configured to selectively mechanically engage and electrically connect with female connectors 108. Each of the male connectors 114 includes a body 700 with a first mating interface 402A at a top of the body 700 (e.g., at the top of the housing 112) and a second mating interface 402B at a bottom of the body 700 (e.g., at the bottom of the housing 112). Together, the bodies 700 of the male connectors 114 are integrally connected with one another to form the block assembly housing 112. Further, each of the male connectors 114 include an insulation feature 404 positioned within the body 700 and electrical connections 406 positioned within the insulation feature 404 (and the body 700).

Referring to FIGS. 7A-7F, the housing 112 includes left and right bottom posts 408A, 408B downwardly extending from a bottom surface of the housing 112, as described above. The body 700 defines a first opening 709A at a top surface of the body 700, a second opening 709B at a bottom of the body 700, and an interior 709C therebetween. The male connectors 114 include a bottom through slot 710 at a bottom of the body 700 extending from a front surface to a back surface of the body 700. The bottom through slot 710 is shown as having a rectangular cross-section for ease of manufacturing, although other shapes could be used. The bottom through slot 710 provides access for electrical connections 406 of the male connectors 114 to exit the body 700 for wiring to the printed circuit board 106.

The male connectors 114 include a port 412 extending downwardly from the top surface of the housing body 112 to an internal shelf 714. The port 412 is non-circular (e.g., ovular) in shape and corresponds in size and shape to the first endcap 206A of the female connector 108 to receive at least a portion of the first endcap 206A within the port 412, as explained in more detail below. Further the port 412 includes tapered walls 413 facilitate alignment of the female connectors 108 and male connectors 114. The internal shelf 714 defines a non-circular opening 716 (e.g., ovular) therethrough, and the male connectors 114 define a vertical conduit 718 extending between the non-circular opening 716 and the bottom through slot 408. The non-circular opening 716 and vertical conduit 718 provide access to electrical connections 406 of the male connectors 114 for electrical connection with the female connectors 108.

The body 700 defines an upper flange 422 at or proximate to a top surface thereof and extending from a back surface of the body 700. As explained in more detail below, the upper flange 422 of the block assembly 104 provides mechanical engagement with the retaining clip 134 of the female connector 108 (in FIGS. 1A-3C). The upper flange 422 includes a chamfer 434 to facilitate engagement of the male connector 114 with the retaining clip 134 of the female connector 108.

Figure 7A:
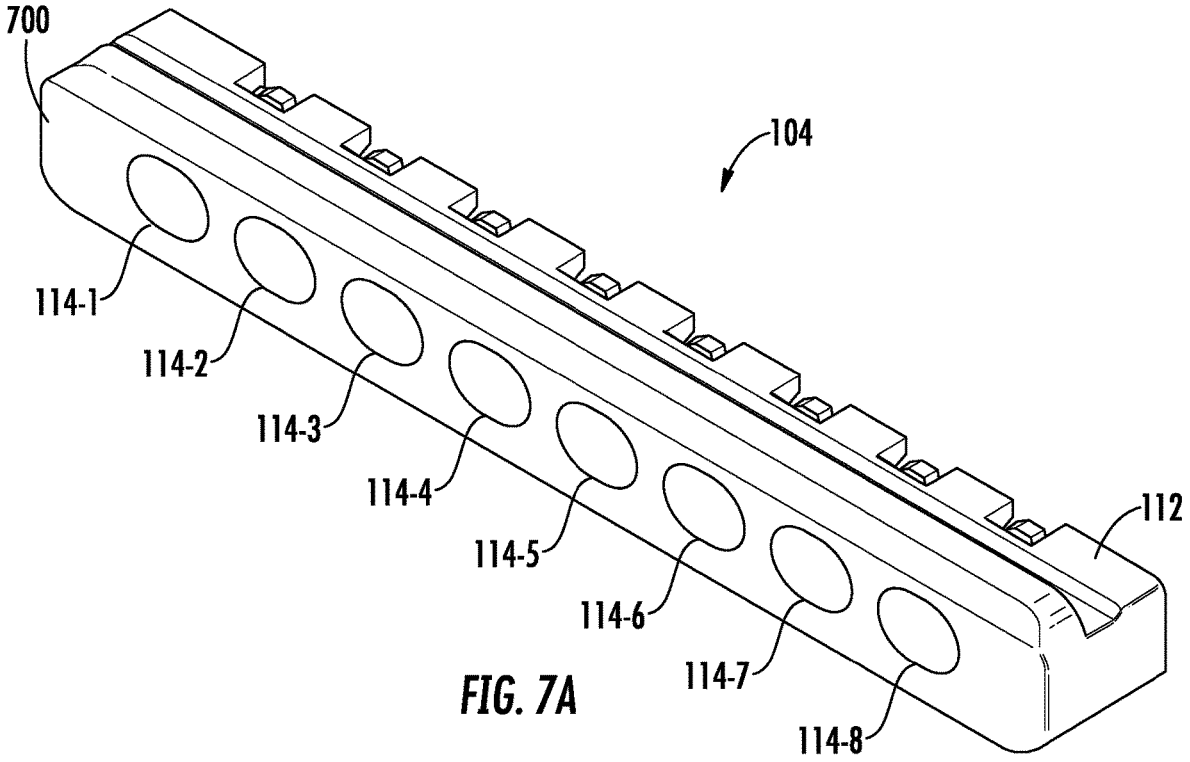
FIG. 7A is a top perspective view of a fourth embodiment of the block assembly of FIGS. 1A and 1C.
Figure 7B:
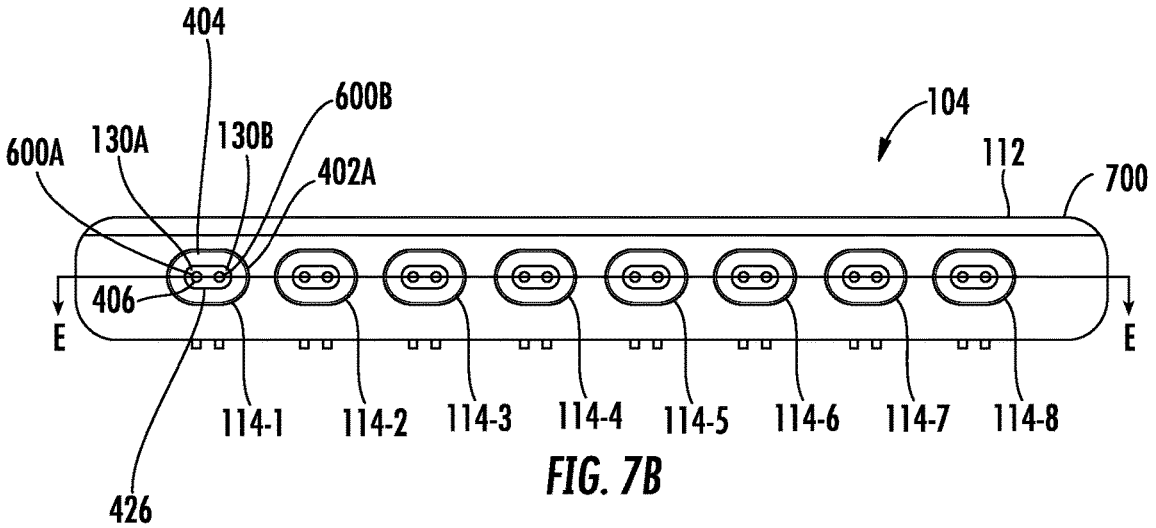
FIG. 7B is a top view of the block assembly of FIG. 7A.
Figure 7C:
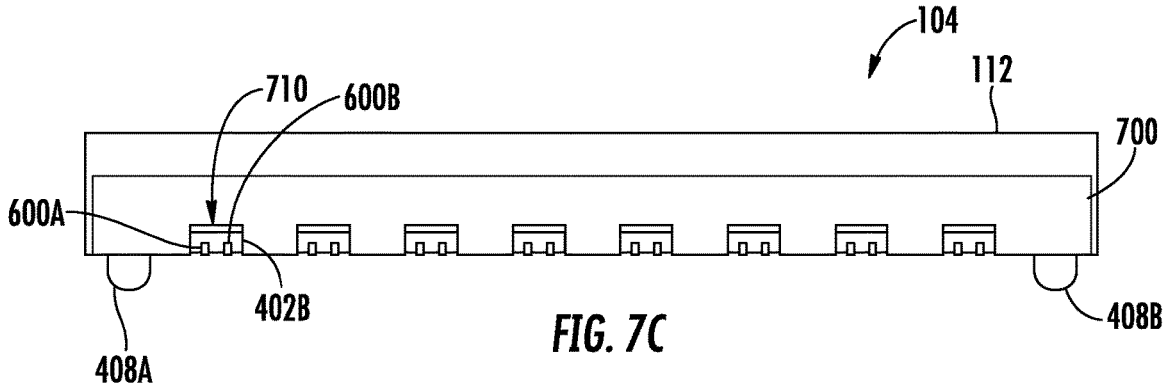
FIG. 7C is a front view of the block assembly of FIG. 7A.
Figure 7D:
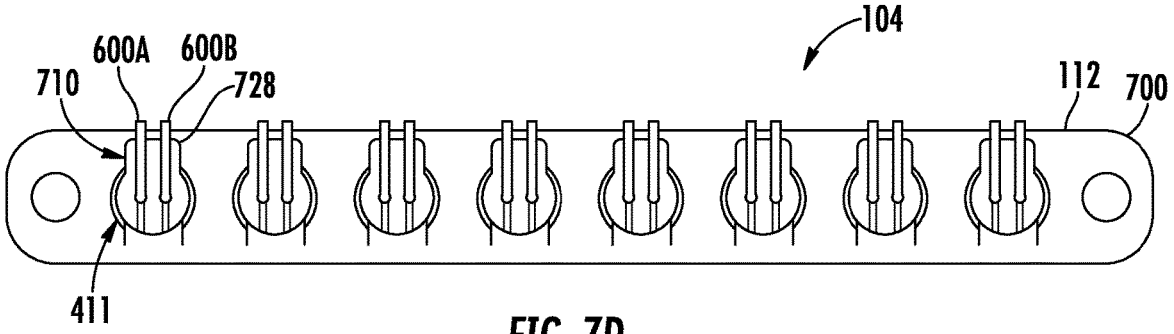
FIG. 7D is a bottom view of the block assembly of FIG. 7A.
Figure 7E:
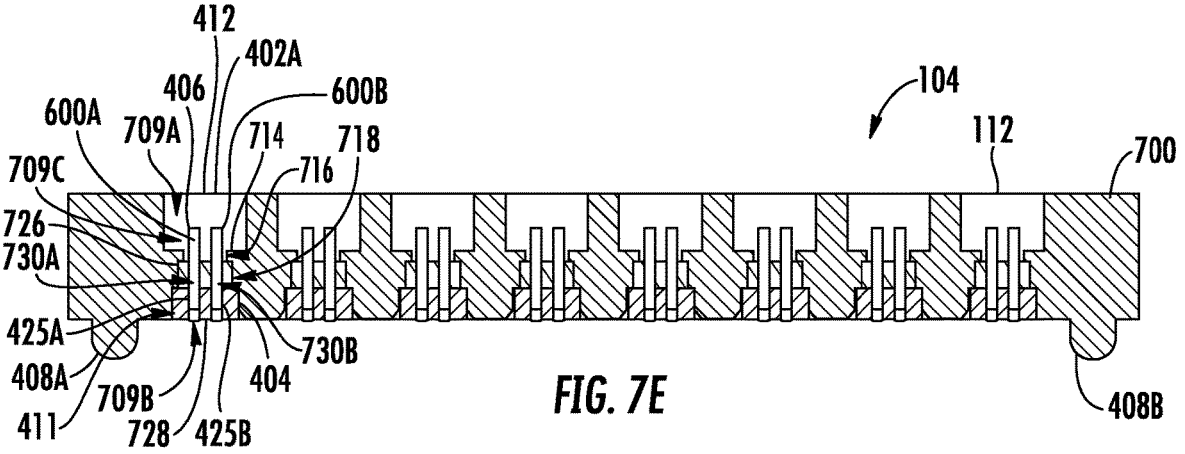
FIG. 7E is a cross-sectional front view of the block assembly of FIG. 7A taken along line E-E of FIG. 7B.

Referring to FIG. 7E, the insulation feature 404 defines a left channel 425A and a right channel 425B to receive electrical connections 406 therein. In particular, the insulation feature 404 includes a first dielectric 726 positioned within the vertical conduit 718 of the body 700 and a second dielectric 728 press fit into the bottom recess 411. The first dielectric 726 and the second dielectric 728 mount the electrical connections 406 within the body 700. In particular, the first dielectric 726 defines a left channel 730A and a right channel 730B adjacent and parallel to the left channel 730A.

Figure 7F:
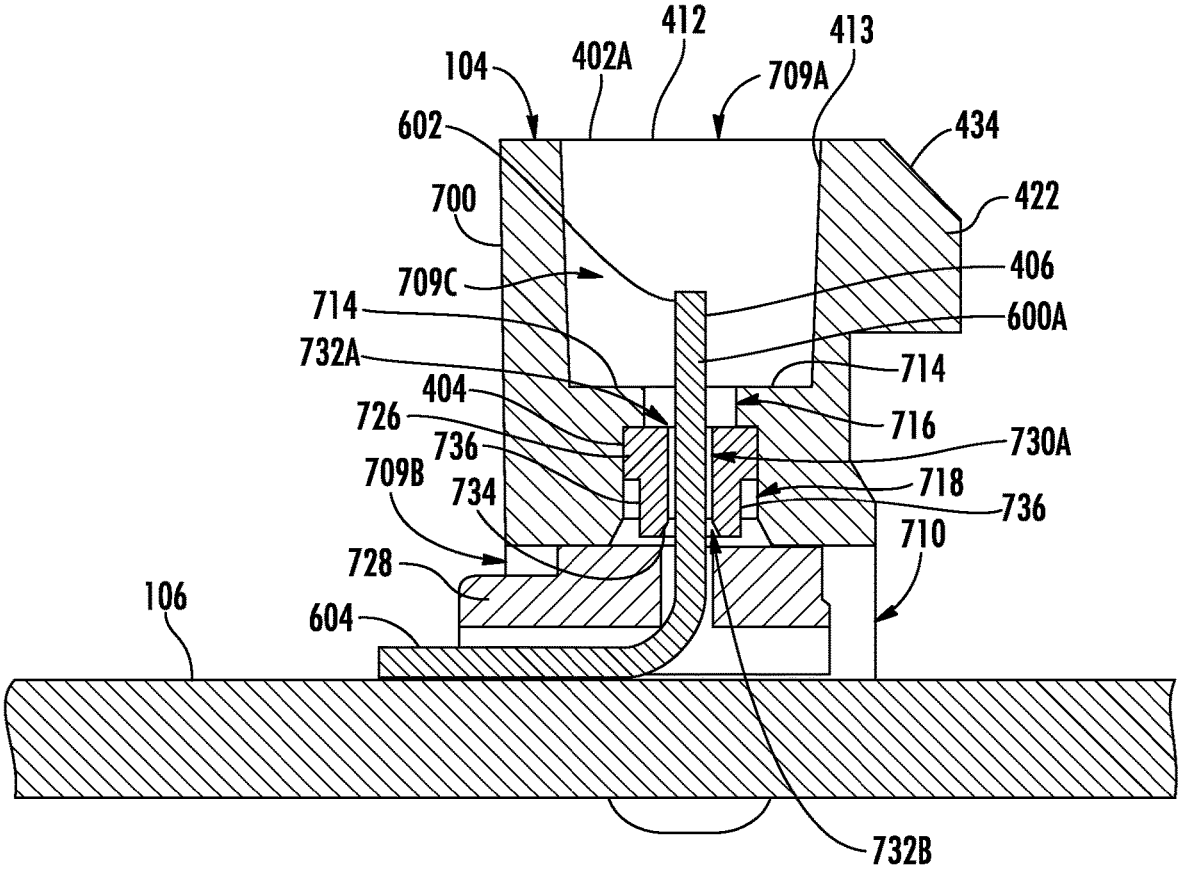
FIG. 7F is a cross-sectional side view of the block assembly of FIG. 7A.

Referring to FIGS. 7E-7F, each of the channels 730A, 730B defines a top opening 732A and a bottom opening 732B (opposite the first opening 732A). The bottom opening 732B includes a chamfer 734 at or proximate the bottom opening 732B for insertion of electrical connections 406 into the left channel 730A and the right channel 730B, as described in more detail below. The first dielectric 726 also includes one or more notches 736 (see FIG. 7F) in an external surface of the first dielectric at or proximate the bottom opening 732B to easily visually indicate to a user the proper orientation of the first dielectric 726 and corresponding chamfer 734 relative to the body 700 when assembling the first dielectric 726 within the body 700.

Figure 7G:
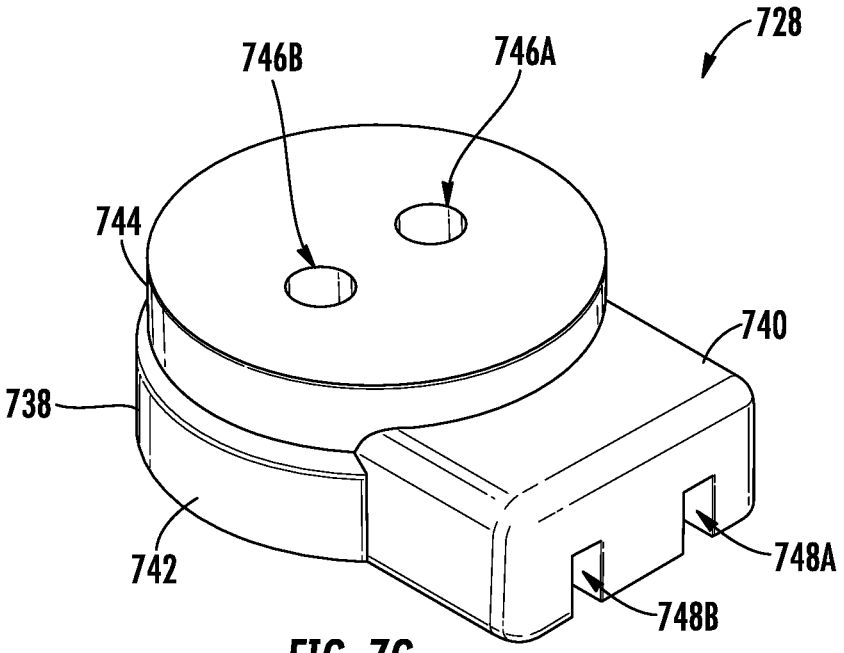
FIG. 7G is a top perspective view of a bottom dielectric of the block assembly of FIG. 7A.
Figure 7H:
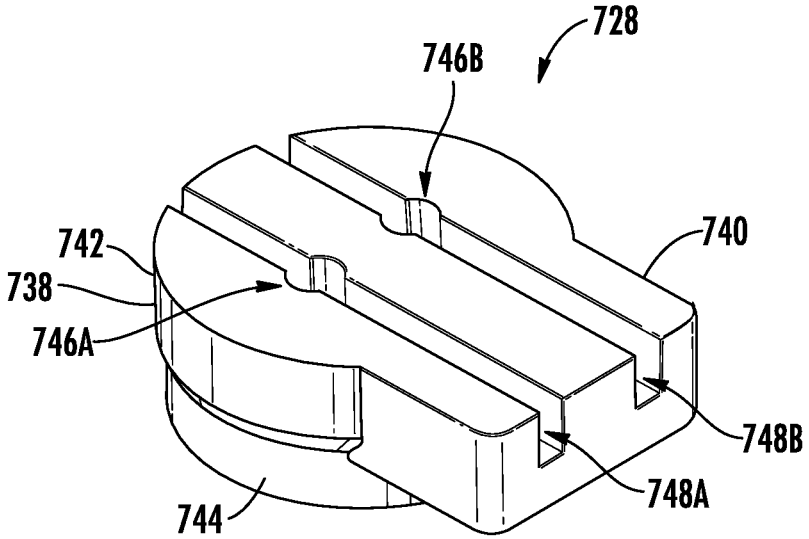
FIG. 7H is a bottom perspective view of the bottom dielectric of FIG. 7F.

Referring to FIGS. 7G-7H, the second dielectric 728 includes a circular portion 738 and a rectangular portion 740 extending from a periphery of the circular portion 738. The circular portion 738 includes a lower portion 742 and an upper portion 744, where the upper portion 744 is a smaller diameter than the lower portion 742. The height of the rectangular portion 740 extends from a bottom surface of the second dielectric 728 upward to about the bottom of the upper portion 744. In this way, the upper portion 744 of the circular portion 738 has a circular periphery, thereby allowing the upper portion 744 of the second dielectric 728 to be press fit into the bottom circular recess 411 of the male connector 114. In this way, the rectangular portion 740 of the second dielectric 728 is positioned within the bottom through slot 710. Accordingly, the rectangular portion 740 provides structure to the electrical connections 406 (explained below in more detail) and also prevents any accidental or inadvertent rotation of the second dielectric 728 within the body 700.

The second dielectric 728 further defines a left vertical channel 746A and a right vertical channel 746B extending from a top surface to a bottom surface of the circular portion 738 of the second dielectric 728. The second dielectric 728 further defines a left horizontal channel 748A and a right horizontal channel 748B upwardly extending from a bottom surface of the second dielectric 728 and extending from a back surface of the rectangular portion 740 through the rectangular portion 740 and through the circular portion 738. The left vertical channel 746A intersects the left horizontal channel 748A, and the right vertical channel 746B intersects the right horizontal channel 748B. When assembled, the left and right channels 730A, 730B of the first dielectric 726 are aligned with the left and right vertical channels 746A, 746B of the second dielectric and together form the left and right channels 425A, 425B of the insulation feature 404. In this way, the left horizontal channel 748A, the right horizontal channel 748B, the left vertical channel 746A and the right vertical channel 746B are configured to receive at least a portion of the electrical connections 406 to mount the electrical connections 406 within the second dielectric 728 and to mount the electrical connections 406 within the body 700 of the male connector 114.

Referring to FIGS. 7B-7F the electrical connections 406 include a left conductor pin 600A and a right conductor pin 600B. Each of the left conductor pin 600A and the right conductor pin 600B include a first leg 602 and a second leg 604 perpendicular to the first leg 602. Accordingly, each conductor pin 600A, 600B includes a first end 460A at the first leg 602 and a second end 460B at the second leg 604.

The first leg 602 of the left and right conductor pins 600A, 600B are positioned within and extend through the left and right channels 730A, 730B of the first dielectric 726 and the left and right vertical channels 746A, 746B of the second dielectric 728. The second leg 604 of the left and right conductor pins 600A, 600B are positioned within and extend through the left and right horizontal channels 748A, 748B of the second dielectric 728. In this way, the first leg 602 of the left and right conductor pins 600A, 600B extend into the port 412 of the body 700 of the male connector 114, providing for the left and right conductor pins 600A, 600B to engage the female connector 108.

When the female connector 108 is engaged with the male connector 114, the first peripheral end 228 of the first endcap 206A contacts the internal shelf 714 of the male connector 114, thereby providing a grounding path between the female connector 108 and the male connector 114.

FIGS. 8A-8E are views of a male cable assembly 800. Male cable assembly 800 includes a male connector 802, as well as cabling 804 (also referred to as twinaxial cabling, etc.). The male connector 802 is similar to the male connectors of FIGS. 1A, 1C, 4A-4E, and 7A-7F, except where otherwise noted. It is noted that twinaxial cables and connectors are described herein, but that the features disclosed may also be used with coaxial cables and connectors and/or other types of cables and connectors.

Referring to FIGS. 8A-8D, the male connector 802 is configured to selectively mechanically engage and electrically connect with the female connector 108. The male connector 802 includes a body 806 with a mating interface 808 at a front of the body 806. Further, the male connector 802 includes an insulation feature 404 positioned within the body 806 and electrical connections 406 positioned within the insulation feature 404 (and the body 806). Further, the body 806 defines a first opening 810A at a front surface of the body 806, a second opening 810B at a back of the body 806, and an interior 810C therebetween.

The male connector 114 includes a port 412 extending inwardly from the front surface of the body 806 to an internal shelf 812. The port 412 is non-circular (e.g., ovular) in shape and corresponds in size and shape to the first endcap 206A of the female connector 108 to receive at least a portion of the first endcap 206A within the port 412, as explained above and explained in more detail below. Further the port 412 includes tapered walls 413 to facilitate alignment of the female connectors 108 and male connectors 114. The internal shelf 812 defines a circular opening 814 (e.g., ovular) therethrough to provide access to electrical connections 406 of the male connectors 114 for electrical connection with the female connectors 108.

The body 806 defines an upper flange 422 at or proximate to a top surface thereof and extending from a front surface of the body 806. As explained above and in more detail below, the upper flange 422 of the male connector 802 provides mechanical engagement with the retaining clip 134 of the female connector 108 (in FIGS. 1A-3C). The upper flange 422 includes a chamfer 434 to facilitate engagement of the male connector 114 with the retaining clip 134 of the female connector 108.

The body 806 further includes an outer shoulder 816 outwardly extending at or proximate to the second opening 810B. A first notch 818A and a second notch 818B opposite the first notch 818A are defined within the outer shoulder 816 of the body 806 at or proximate the second opening 810B. This allows for at least a portion of the insulation feature 404 to be inserted and secured within the body 806, as explained in more detail below. In particular, the first and second notches 818A, 818B engage the insulation feature 404 to align the insulation feature 404 within the body 806 and prevent relative rotation thereof.

The male connector 802 further includes an endcap 820, where the body 806 and the endcap 820 house the insulation feature 404 and at least a portion of the cabling 804 therein. Further, the body 806 and endcap 820 may be made of metal and provide a grounding path between the cabling 804 and the female connector 108. It is noted that the endcap 820, first endcap 206A, and the second endcap 206B are of an identical construction for ease of construction (e.g., by stamping) and to reduce manufacturing costs. In particular, the endcap 820 defines a first opening 224A-3, a second opening 224B-3, and an interior 224C-3 therebetween. The endcap 820 further includes a non-circular wall 226-3 (also referred to herein as an ovular wall) towards the first opening 224A-3 with a first peripheral end 228A-3, a circular wall 230-3 towards the second opening 224B-3 with a second peripheral end 228B-3, and an intermediate wall 232-3 positioned therebetween. The circular wall 230-3 is configured (e.g., sized and shaped) to fit over an end of the body 806. More specifically, the second opening 810B of the body 806 (and the outer shoulder 816 thereof) is positioned within the second opening 224B-3 of the endcap 820. The second peripheral end 228B-3 of the endcap 820 is then rolled, such as around the outer shoulder 816 of the body 806, to attach the endcap 820 to the body 806. Alternatively, or additionally, the endcap 820 and the body 806 may be press fit into each other, such that the outer diameter of the body 806 is slightly larger than the inner diameter of the circular wall 226-3 of the endcap 820. When attached to one another, a grounding path is formed at least between the back of the body 806 and an interior surface of the intermediate wall 232-3 of the endcap 820, and/or between the second peripheral end 228B-3 and the outer shoulder 816.

The insulation feature 404 includes a dielectric 822 positioned within the body 806. The dielectric 822 mounts the electrical connections 406 within the body 806. In particular, the dielectric 822 defines a left channel 824A and a right channel 824B adjacent and parallel to the left channel 824A. Each of the channels 824A, 824B defines a front opening 826A and a back opening 826B (opposite the front opening 826A). The back opening 826B includes a chamfer 828 at or proximate the back opening 826B for insertion of electrical connections 406 into the left channel 824A and the right channel 824B. The dielectric 822 also includes one or more prongs 830 extending at or towards a back of the dielectric 822 to rotationally align the left and right channels 824A, 824B within the housing 806, as explained in more detail below.

Cabling 804 includes left and right conductors 832A, 832B positioned within left and right channels 834A, 834B of a cabling dielectric 836, which is itself positioned within a jacket 838. At least a portion of the left and right conductors 832A, 832B extends from within the jacket 838 of the cabling 804 through the endcap 820 (e.g., first opening 224A-3, second opening 224B-3, and interior 224C-3), through the dielectric 822 (e.g., the left and right channels 824A, 824B). In this way, ends of the first and second conductors 832A, 832B are positioned within the port 412 to engage the female connector 108.

Figure 8A:
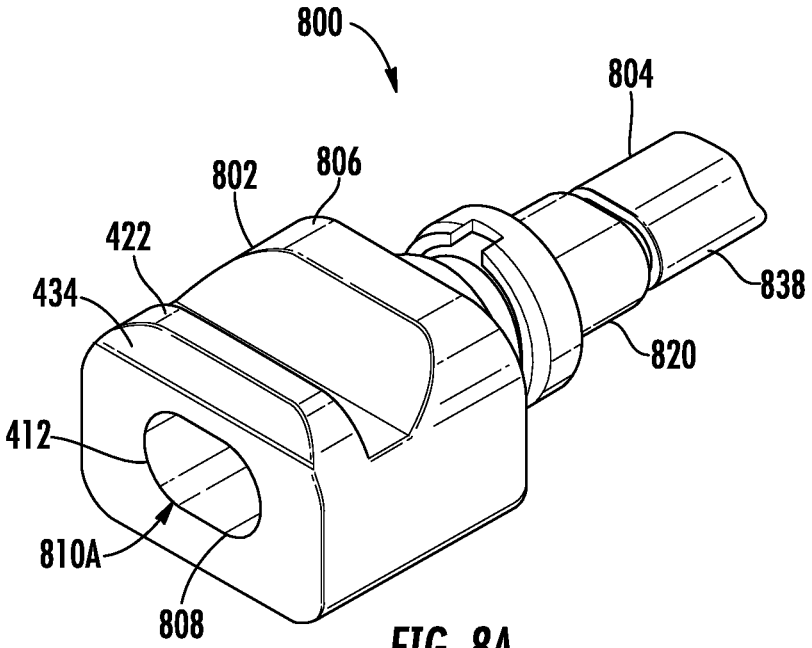
FIG. 8A is a perspective view of a male cable assembly including another embodiment of the male connector of the block assembly of FIGS. 1A and 1C.
Figure 8B:
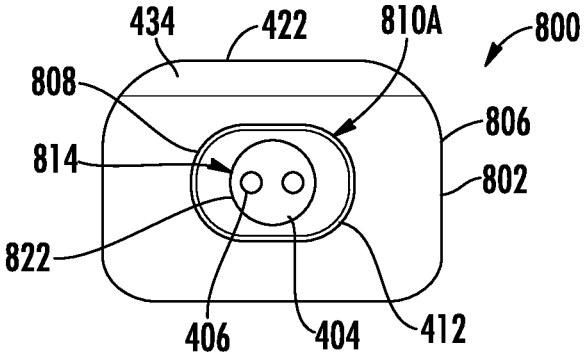
FIG. 8B is a front view of the male cable assembly of FIG. 8A.
Figure 8C:
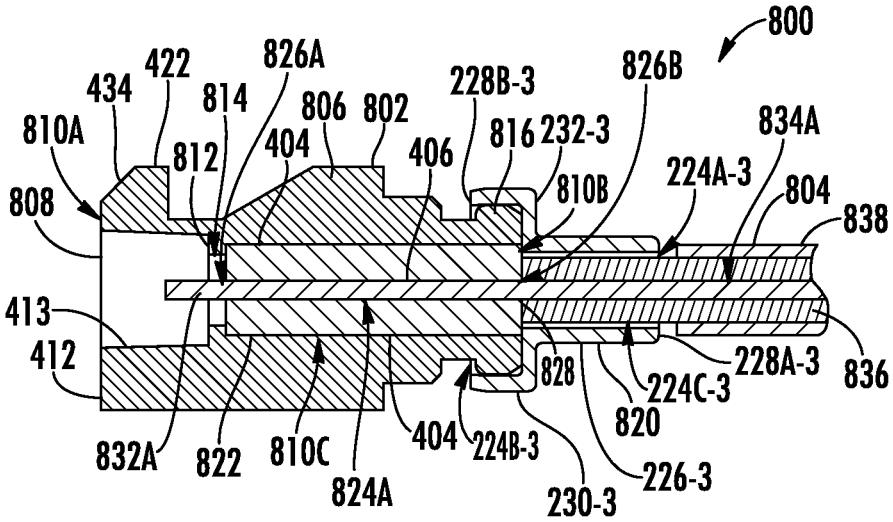
FIG. 8C is a cross-sectional side view of the male cable assembly of FIG. 8A.
Figure 8D:
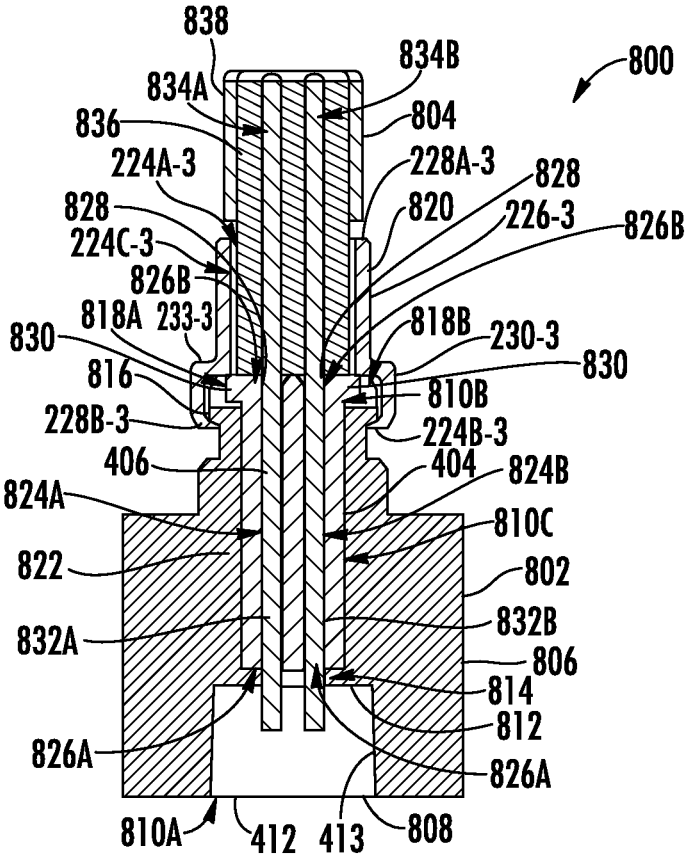
FIG. 8D is a cross-sectional top view of the male cable assembly of FIG. 8A.
Figure 8E:
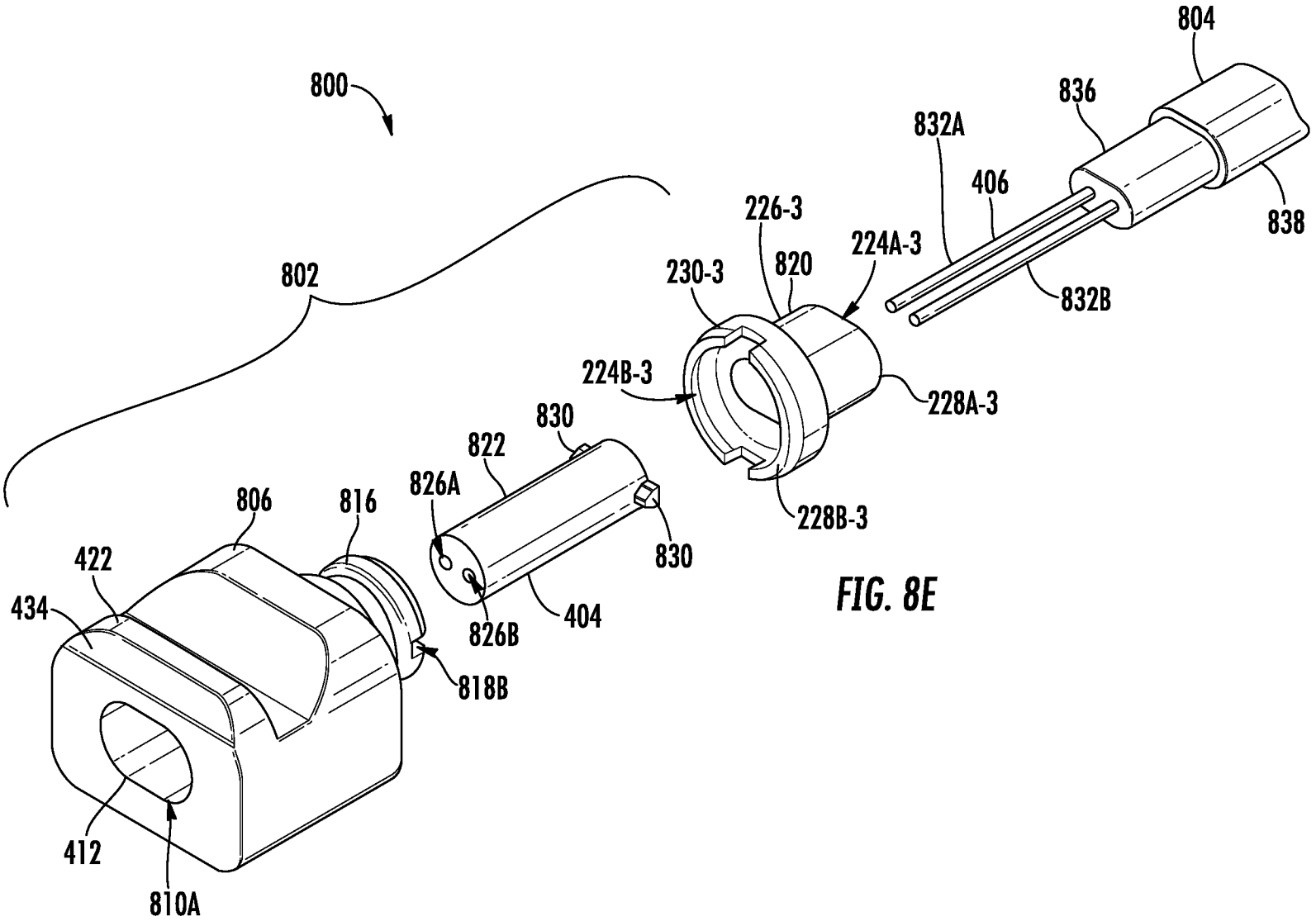
FIG. 8E is an exploded view of the male cable assembly of FIG. 8A.
Figure 8F:
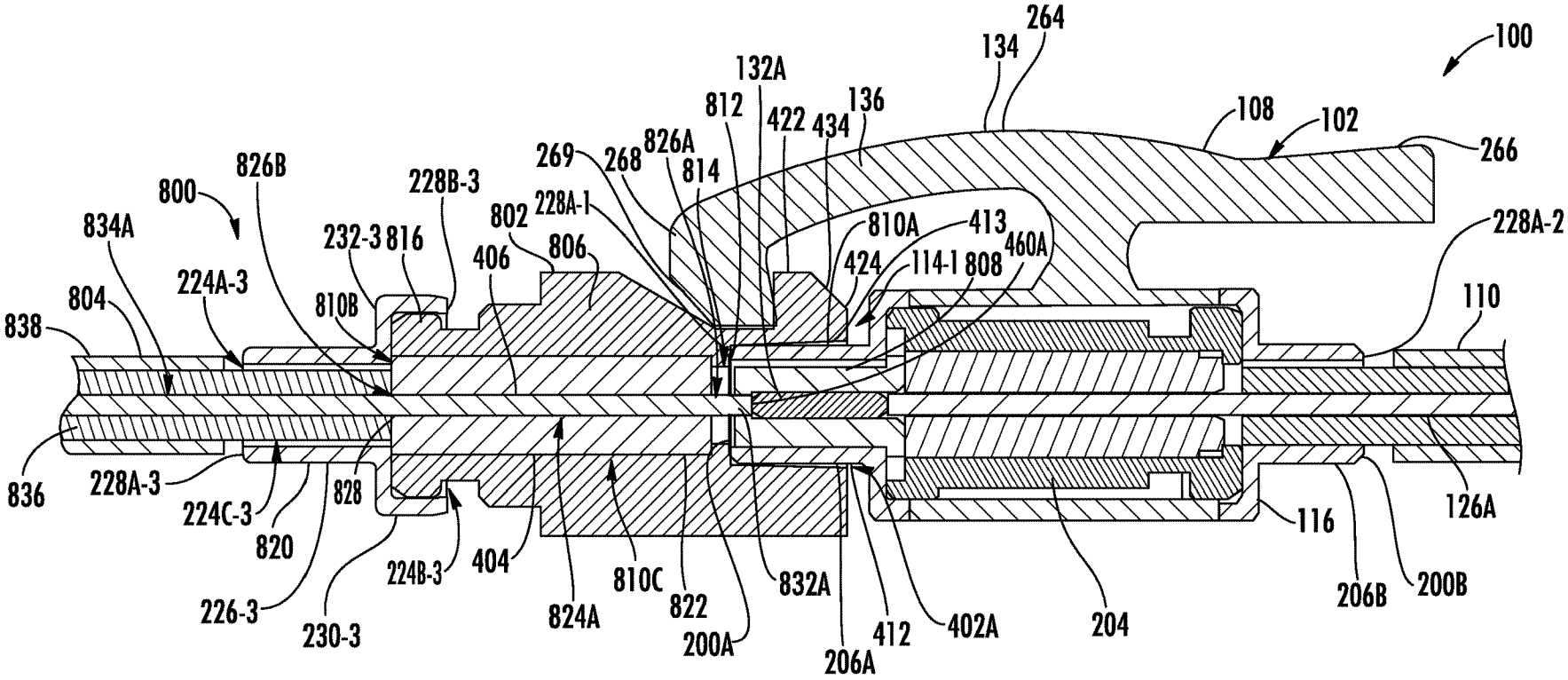
FIG. 8F is a cross-sectional side view of the female cable assembly of FIGS. 1A-1B and 2A-2C and the male cable assembly of FIGS. 8A-8D.

Referring to FIG. 8F, a cross-sectional side view of the female cable assembly of FIGS. 1A-1B and 2A-2C and the male cable assembly of FIGS. 8A-8D are shown. The female cable assembly 102 and the male cable assembly 800 operate as similarly discussed with respect to FIGS. 4K and 5D except where otherwise noted. In particular, once the female connector 108 and the male connector 802 are fully engaged, the first peripheral end 228A-1 of the first endcap 206A is in contact with the internal shelf 812 of the male connector 802, thereby establishing a grounding path from the endcap 820 to the body 806 of the male connector 802, and from the internal shelf 812 of the body 806 of the male connector 802 to the first peripheral end 228A-1 of the first endcap 206A, through the body casing 204, and through the second endcap 206A. As noted above, when fully engaged, the prong 268 is forced to flex forward, towards the first end 200A of the female connector 108. This tension forces the female connector 108 forward to maintain a solid grounding connection and compensate for tolerance differences between the first endcap 206A of the female connector 108 and the internal shelf 812 of the body 806 of the male connector 802.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A twinaxial cable connector, comprising:

a housing comprising a housing first end and a housing second end;

at least one dielectric positioned within the housing, the at least one dielectric comprising a dielectric first end and a dielectric second end, the at least one dielectric defining a first channel and a second channel parallel to each other and extending from the dielectric first end to the dielectric second end, the first channel configured to receive at least a portion of a first conductor of a twinaxial cable and the second channel configured to receive at least a portion of a second conductor of the twinaxial cable; and a non-circular interface, at least a portion of the non-circular interface configured for insertion into a mating connector wherein the non-circular interface is configured to orient the first and second conductors of the twinaxial cable with first and second electrical connections of the mating connector, wherein the housing comprises a first endcap, a second endcap, and a casing body positioned therebetween, the first endcap and second endcap each comprising a non-circular wall, the casing body comprising a circular wall.

2. The twinaxial cable connector of claim 1, further comprising a first spring-type interconnect positioned in the first channel and a second spring-type interconnect positioned in the second channel.

3. The twinaxial cable connector of claim 1, wherein the at least one dielectric comprises a first dielectric and a second dielectric aligned with the first dielectric, the first dielectric comprising a non-circular portion and the second dielectric comprising a circular portion.

4. A twinaxial cable assembly, comprising:

the twinaxial cable connector of claim 1; and the twinaxial cable comprising the first conductor and the second conductor, the at least a portion of the first conductor positioned within the first channel of the at least one dielectric, and the at least a portion of the second conductor positioned within the second channel of the at least one dielectric.

5. The twinaxial cable connector of claim 1, wherein the non-circular interface comprises two or fewer axes of symmetry.

6. The twinaxial cable connector of claim 5, wherein the non-circular interface comprises an oval interface.

* * * * *